US007913454B2

(12) United States Patent
Sullivan

(10) Patent No.: US 7,913,454 B2
(45) Date of Patent: Mar. 29, 2011

(54) PORTABLE PET PORTAL WITH THREE-POSITION FLAP ASSEMBLY

(75) Inventor: Thomas D. Sullivan, Hamilton, NJ (US)

(73) Assignee: Accession, Inc., Hamilton, NJ (US)

( * ) Notice: Subject to any disclaimer, the term of this patent is extended or adjusted under 35 U.S.C. 154(b) by 498 days.

(21) Appl. No.: 12/148,069

(22) Filed: Apr. 16, 2008

(65) Prior Publication Data

US 2009/0260294 A1 Oct. 22, 2009

(51) Int. Cl.
*E05D 15/48* (2006.01)

(52) U.S. Cl. ..... 49/169; 49/504; 49/163; 160/180

(58) Field of Classification Search ..... 49/363, 49/369, 504, 163, 169; 160/180
See application file for complete search history.

(56) References Cited

U.S. PATENT DOCUMENTS

| | | | | | |
|---|---|---|---|---|---|
| 971,617 | A | * | 10/1910 | Jump | 49/254 |
| 1,902,545 | A | * | 3/1933 | Ditchfield | 160/203 |
| 2,758,646 | A | * | 8/1956 | Johnson | 160/354 |
| 2,930,353 | A | * | 3/1960 | Sievers | 119/841 |
| 3,184,803 | A | * | 5/1965 | Peel | 49/388 |
| 3,420,001 | A | | 1/1969 | Raymon | 49/407 |
| 3,471,189 | A | | 10/1969 | Ness | 292/262 |
| 3,654,733 | A | | 4/1972 | Blackwell | 49/168 |
| 3,811,224 | A | | 5/1974 | Garrison | 49/168 |
| 3,816,967 | A | | 6/1974 | Littrell | 49/449 |
| 3,878,645 | A | | 4/1975 | Porter | 49/169 |
| 4,047,331 | A | | 9/1977 | Davlantes | 49/171 |
| 4,053,007 | A | * | 10/1977 | Griffith | 160/180 |
| 4,173,099 | A | | 11/1979 | Robb | 49/168 |
| 4,322,913 | A | | 4/1982 | Himmer | 49/168 |
| 4,408,416 | A | | 10/1983 | Davlantes | 49/168 |
| 4,754,797 | A | | 7/1988 | Sronce | 160/354 |
| 4,760,872 | A | * | 8/1988 | Hale, Jr. | 160/90 |
| 4,776,133 | A | | 10/1988 | Green | 49/394 |
| 4,840,217 | A | * | 6/1989 | Evans, III | 160/368.1 |
| 4,927,198 | A | | 5/1990 | Fennell et al. | 292/306 |
| 5,177,900 | A | | 1/1993 | Solowiej | 49/463 |
| 5,185,954 | A | | 2/1993 | Waddle, Sr. | 49/168 |
| 5,261,350 | A | | 11/1993 | Vavrek | 119/19 |
| 5,269,097 | A | * | 12/1993 | Davlantes | 49/169 |
| 5,287,654 | A | | 2/1994 | Davlantes | 49/169 |
| 5,406,748 | A | * | 4/1995 | Davlantes | 49/169 |
| 5,657,592 | A | * | 8/1997 | Davlantes | 52/206 |
| 5,735,079 | A | * | 4/1998 | Davlantes | 49/169 |
| 5,946,855 | A | | 9/1999 | Miconi | 49/163 |
| 6,272,793 | B1 | | 8/2001 | Davlantes | 49/168 |

(Continued)

FOREIGN PATENT DOCUMENTS

GB 2101182 A * 1/1983

*Primary Examiner* — David Dunn
*Assistant Examiner* — David E Allred
(74) *Attorney, Agent, or Firm* — Watov & Kipnes, P.C.; Kenneth Watov

(57) ABSTRACT

A pet portal flap assembly has interior and exterior frames between which moveable flaps are mounted in a swinging door, or in a patio door insert, or in an exterior wall, to permit both ingress and egress of a pet. A handle operated mechanism is provided for selectively vertically positioning the moveable flaps in an uppermost position to permit both ingress and egress of a pet, in a mid-position for only permitting ingress of a pet, and in a lowermost position in which bottom portions of the flaps are locked between the interior and exterior frames to prevent any movement of the flaps.

16 Claims, 44 Drawing Sheets

U.S. PATENT DOCUMENTS 6,385,909 B1 * 5/2002 Marsh et al. ..... 49/169
6,402,111 B1 6/2002 Stewart et al. ..... 248/317
6,681,524 B1 * 1/2004 Tillson ..... 49/169
7,063,123 B2 6/2006 Lethers ..... 160/180
7,207,141 B2 4/2007 Sullivan ..... 49/169
2008/0184940 A1 * 8/2008 Bosserdet et al. ..... 119/484

* cited by examiner

PORTABLE PET PORTAL WITH THREE-POSITION FLAP ASSEMBLY

RELATED INVENTION

The present invention is related to U.S. Pat. No. 7,207,141, issued on Apr. 24, 2007, and entitled "SLIDING DOOR INSERT FOR PORTABLE PET PORTAL." The related patent has the same inventorship, and the same assignee, as the present Application. The teachings of the related patent are incorporated herein by reference to the extent they do not conflict herewith.

BACKGROUND OF THE INVENTION

Pet access doors provide an opening, usually equipped with a swinging flap, through which pets can leave or enter a home or other building. The pet access door may be set in a frame for installation in a wall or solid core door. In order to allow a means of passage for a pet through a sliding glass patio door, the door must be left ajar by sliding the moveable glass door away from the patio door frame. The majority of pet access doors manufactured for sliding glass patio doors consist of a rectangular panel designed to fill the opening created when the sliding glass patio door is ajar. A pet portal is inserted into the rectangular panel providing a means of egress and ingress for the pet. Generally sliding glass patio door pet access doors are constructed of a glass panel in the upper portion and a swinging flap pet portal in the lowermost portion encased in an aluminum frame.

The purpose of the present invention is to provide an improved flap assembly for use as a bottom component of a pet portal. Also, the improved flap assembly can be separately utilized by building it into existing walls or access doors of homes or commercial buildings.

SUMMARY OF THE INVENTION

The present invention provides an improved pet portal flap assembly that can be used in replacement of pet portals of prior pet access doors designed for use in swinging doors, walls, and sliding glass patio doors, for example. Also, and most importantly, the present pet portal flap assembly can be built into existing doors or walls for allowing a pet ingres or egress access to homes and other buildings. The pet portal flap assembly includes a magnetic flap ring weather seal to insure minimum air infiltration, and also is manufactured from injection molded polymer providing superior weather insulation relative to exisiting pet portal flap assemblies. Further unique to the present pet portal flap assembly is the provision of a handle operated mechanism that permits the rotable flap portion to be raised and locked into an uppermost position for providing both ingress and egress to a pet through the pet portal. In a second positioning of the handle and the flap, for retaining the flap in a mid position, the flap is restrained to only swing in a direction for permitting a pet to have ingress into the home or building, while preventing the flap from permitting egress through the portal to outside areas from the home or building. By operating the handle to move the flap to a lowermost position, the lowermost portions of the flap are entrapped within a channel formed between interior and exterior frames associated with the flap, preventing any movement of the flap, thereby locking the flap vertically, while maximizing the weather seal associated with the flap assembly.

In another embodiment of the invention, magnetic means are utilized for retaining individual components of the flap door together when the flap is positioned in its intermediate position for permitting only ingress of a pet through the pet portal. Also, secondary magnetic means are provided in another embodiment of the invention for insuring positive closure of the flap when not being moved inward or outward relative to the vertical plane of the associated door or sliding door insert.

BRIEF DESCRIPTION OF THE DRAWINGS

The present embodiments of the invention are described in detail below with reference to the drawings, in which like items are identified by the same reference designation, wherein.

DETAILED DESCRIPTION OF THE INVENTION

The present invention is as indicated above related to the present inventors' U.S. Pat. No. 7,207,141, the details of which are incorporated herein to the extent that they do not conflict herewith. Note that the flap assembly as shown and described herein is different from that of U.S. Pat. No. 7,207,141.

Figure 1A:
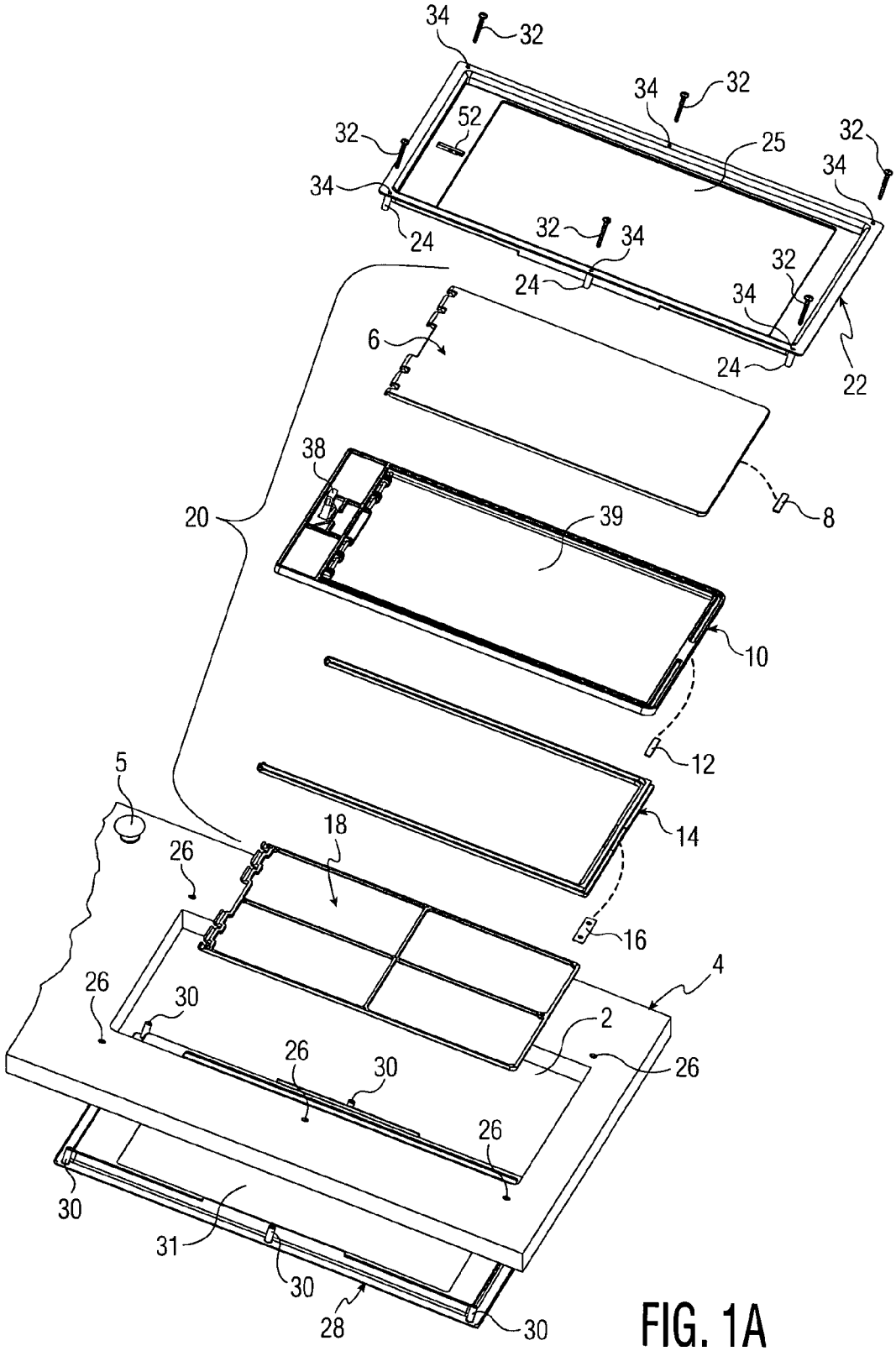
FIG. 1A is an exploded assembly view of the present pet portal flap assembly relative to installation in a swinging door, for example.
Figure 1B:
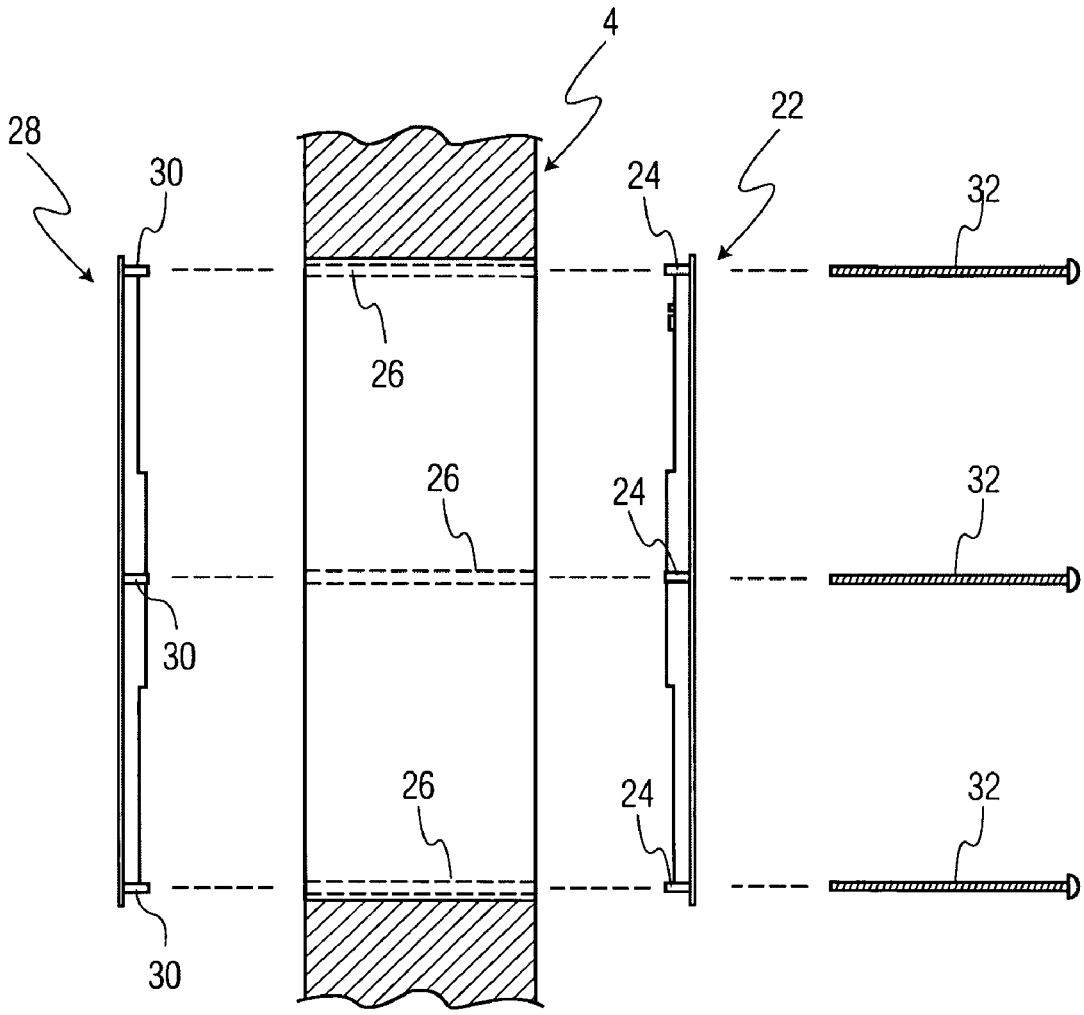
FIG. 1B is an exploded assembly view that is complementary to the exploded assembly view of FIG. 1A.
Figure 2A:
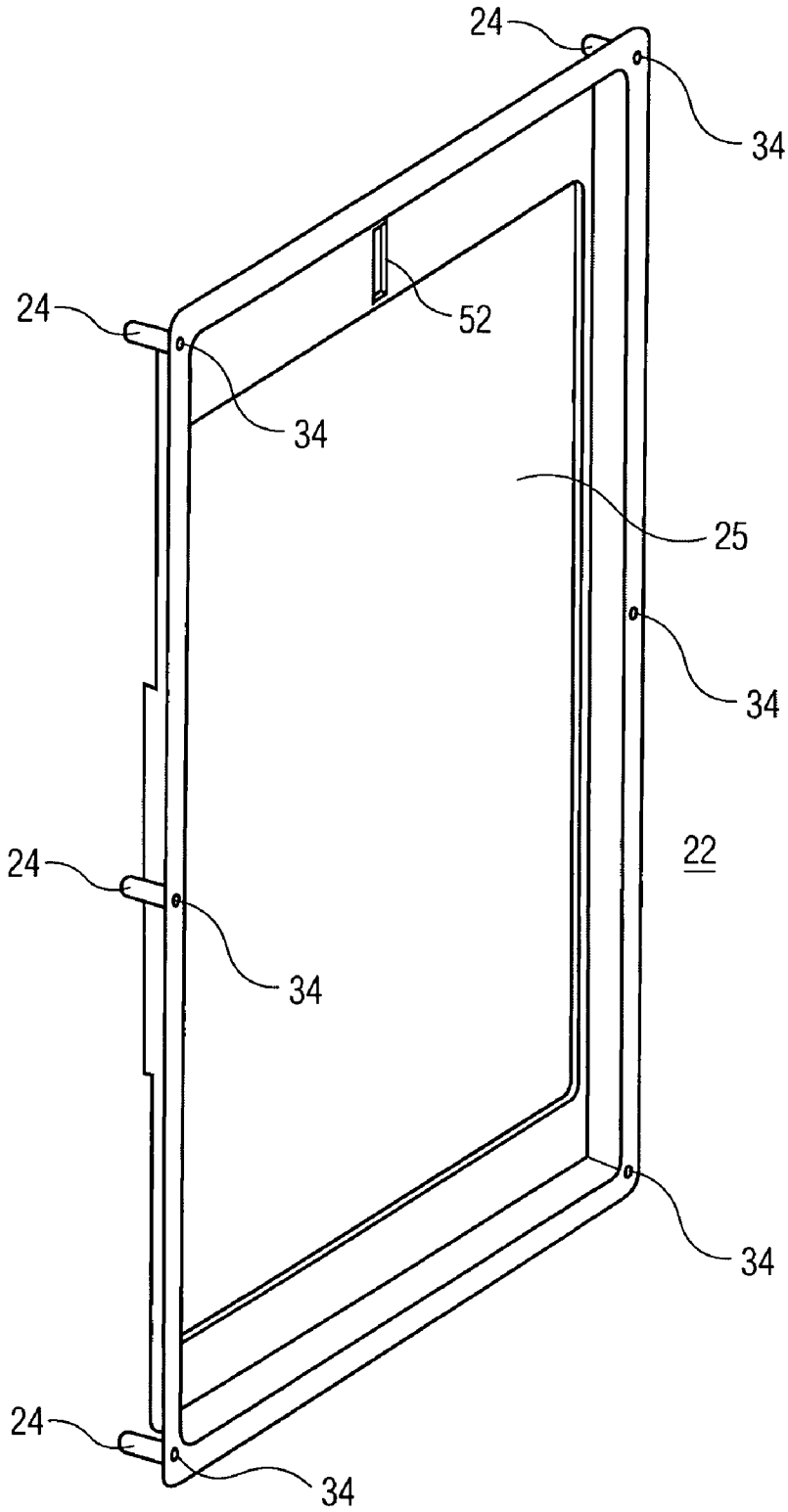
FIGS. 2A through 2E show front pictorial, front elevational, back elevational, left-side elevational (the right-side elevational being a mirror image), and top plan views (the bottom plan view being identical), respectively, of an interior frame for one embodiment of the invention.
Figure 2B:
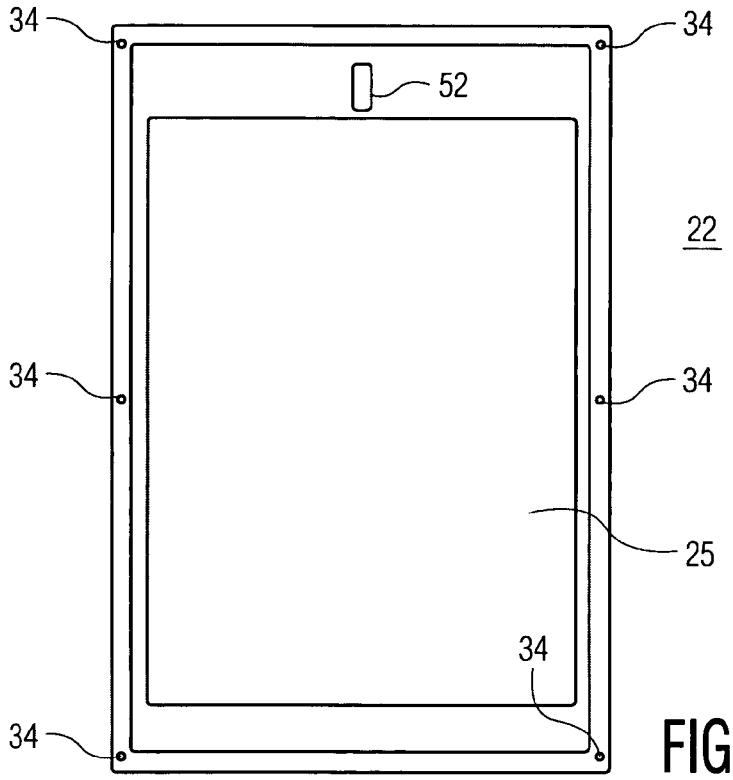
Figure 2C:
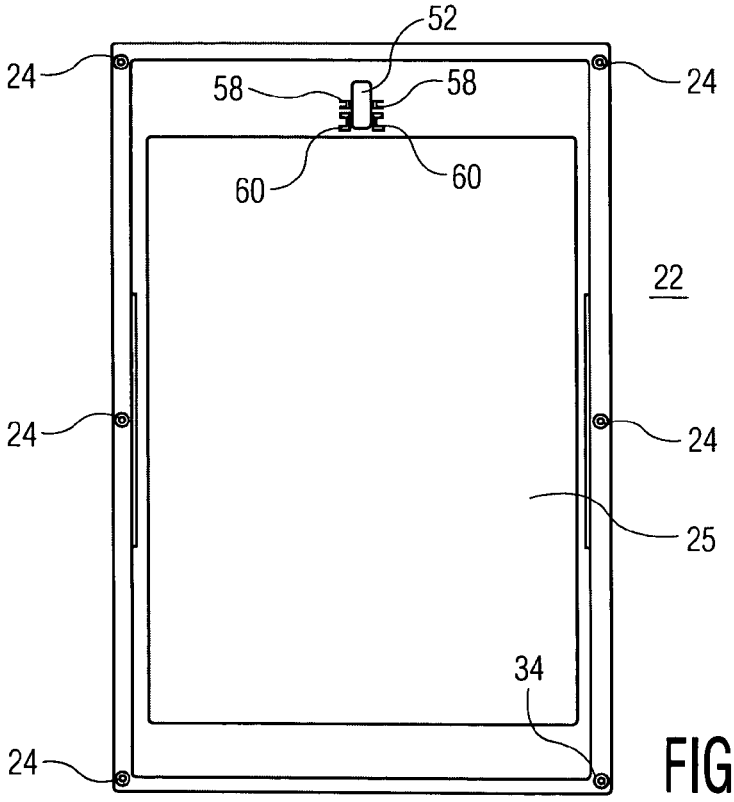
Figure 2D:
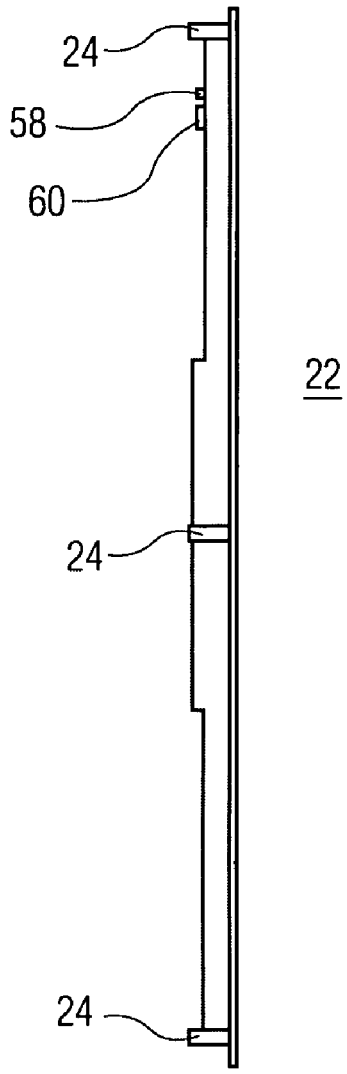
Figure 2E:
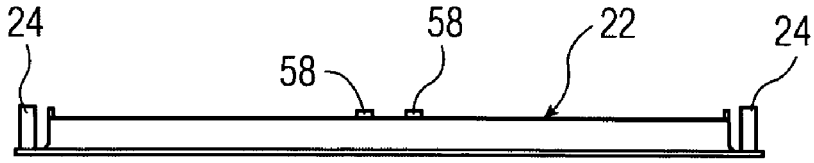
Figure 3A:
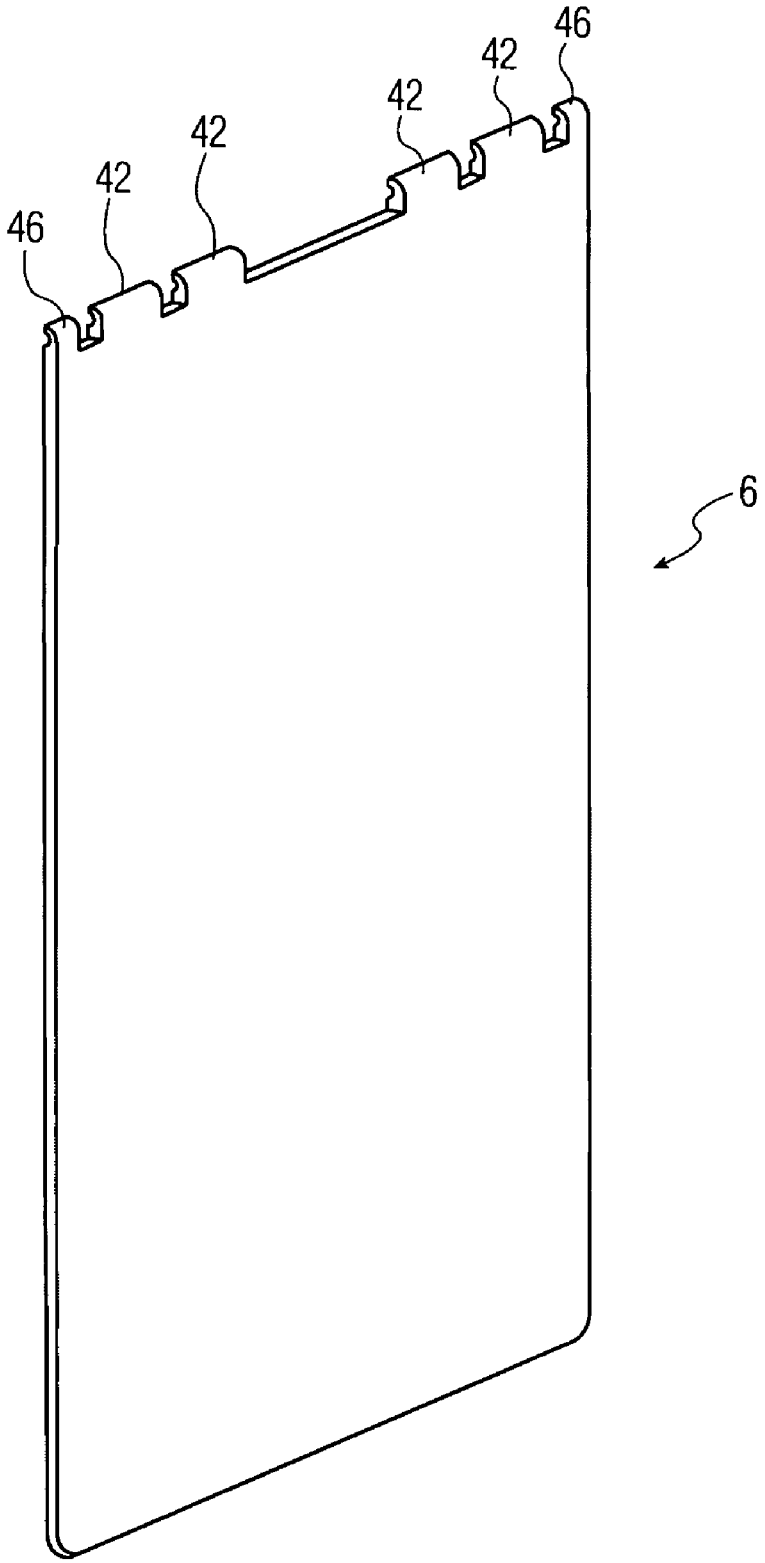
FIGS. 3A through 3F show a front pictorial, front elevational, back elevational, left-side elevational (the right-side elevational being a mirror image), top plan, and bottom plan views, respectively, of an interior flap door for an embodiment of the invention.
Figure 3B:
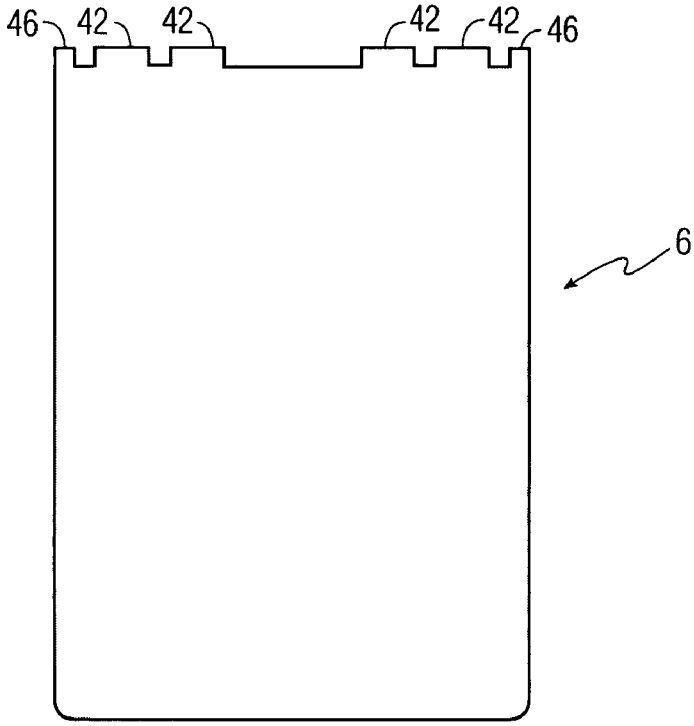
Figure 3C:
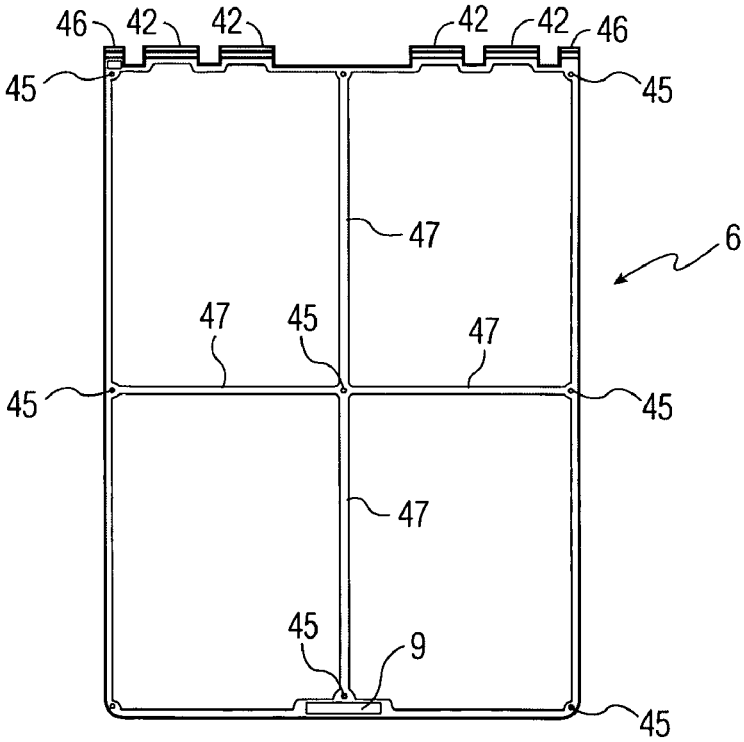
Figure 3D:
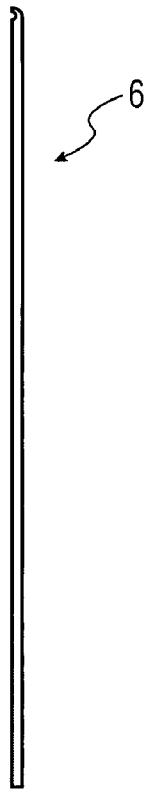
Figure 3E:
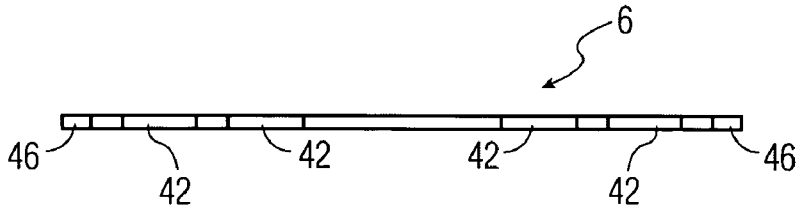
Figure 3F:
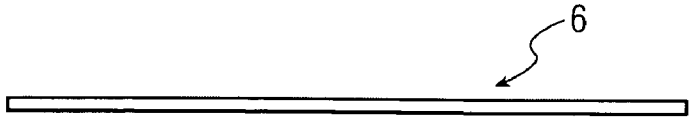
Figure 4A:
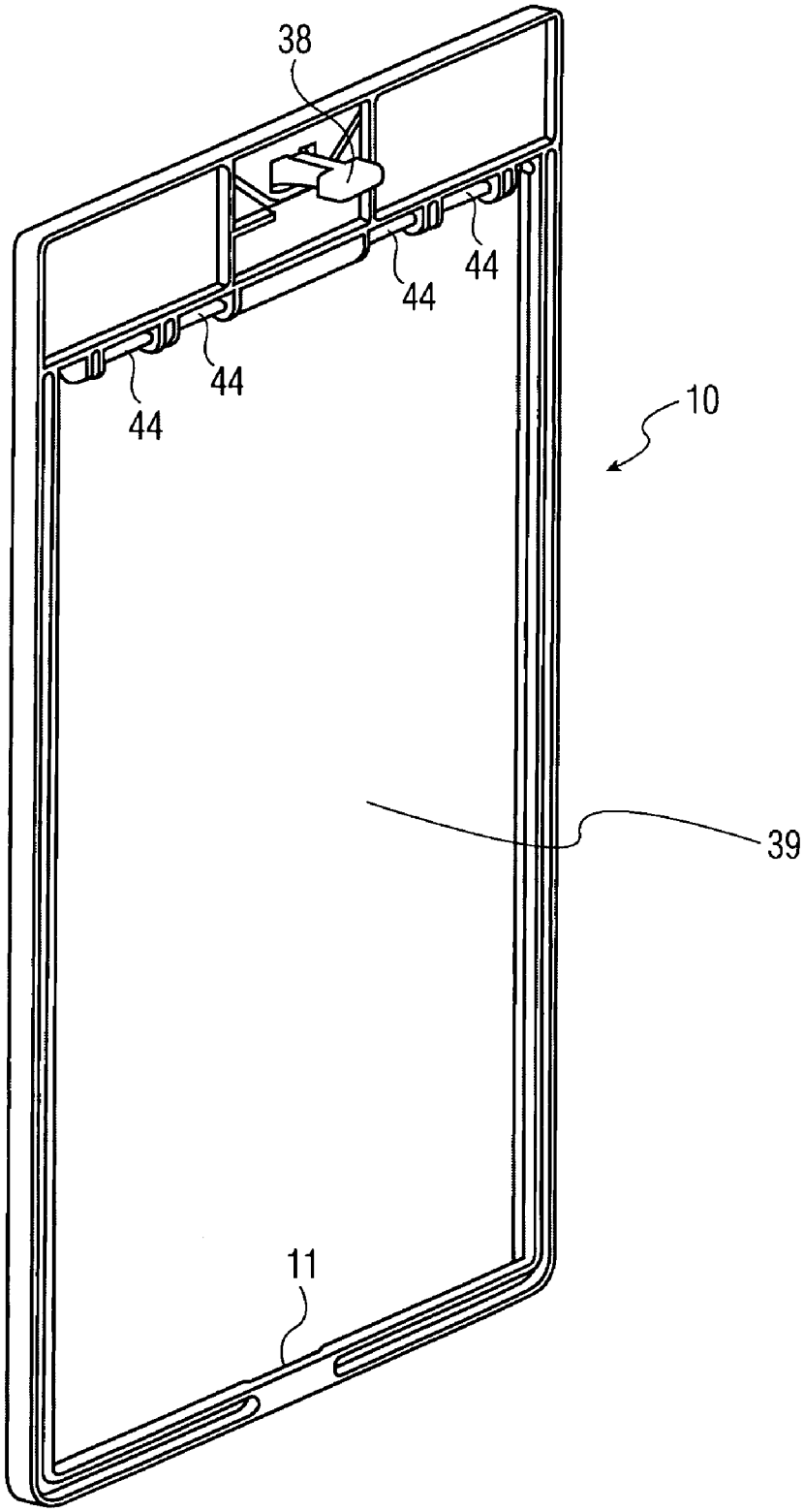
FIGS. 4A through 4E show front pictorial, front elevational, back elevational, left-side elevational (the right-side elevational being a mirror image thereof), and top plan (the bottom plan view is identical) views, respectively, of a bezeled locking hinge for an embodiment of the invention.
Figure 4B:
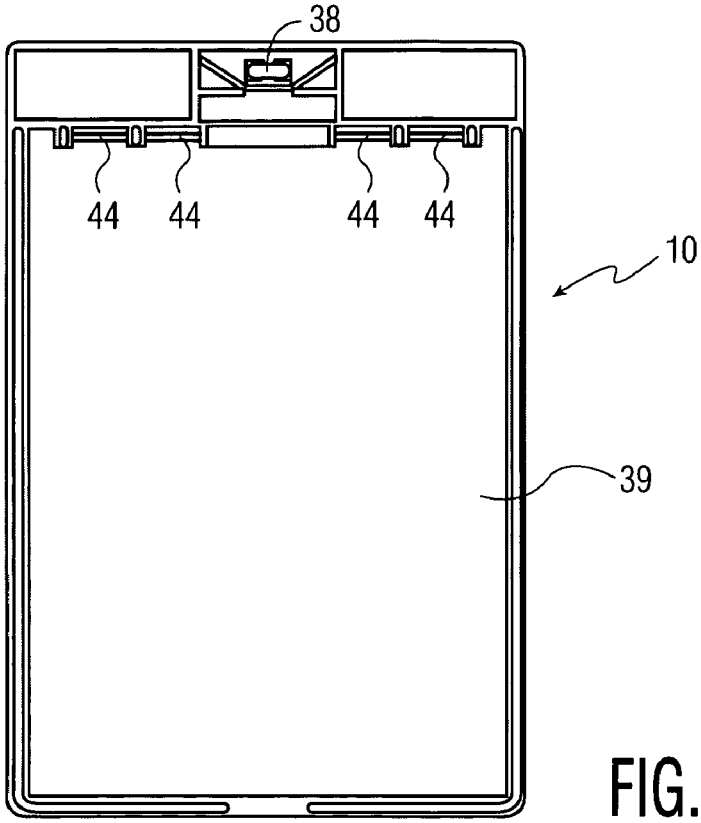
Figure 4C:
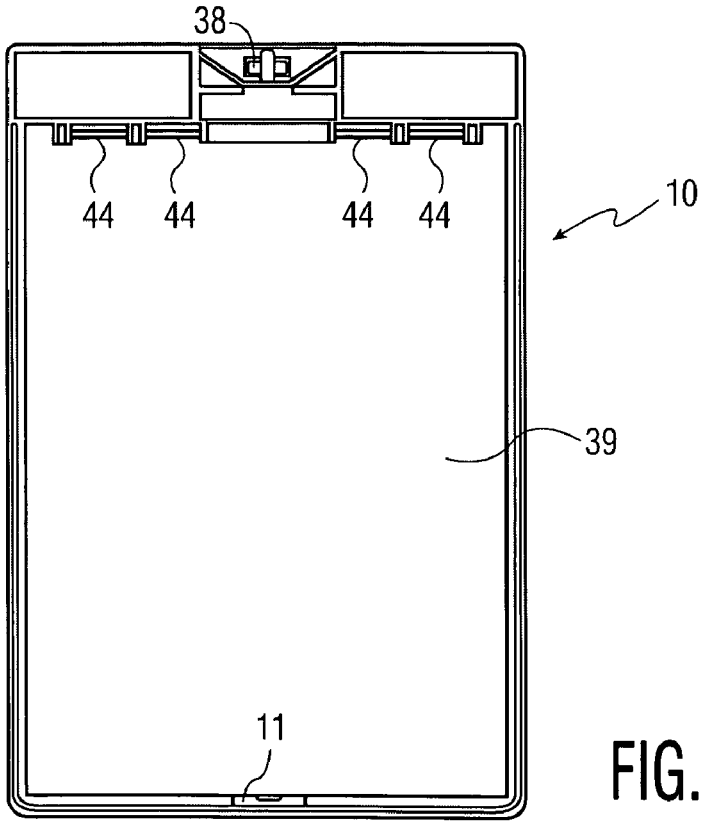
Figure 4D:
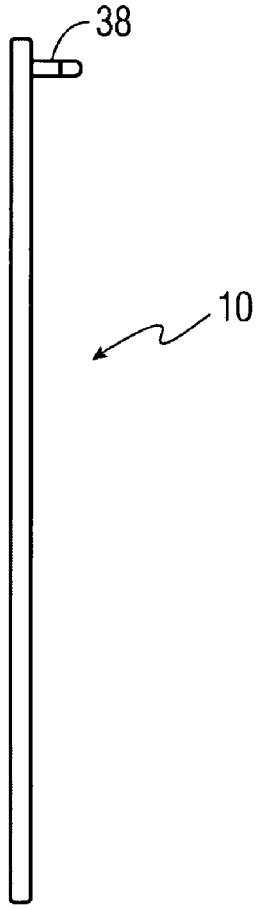
Figure 4E:
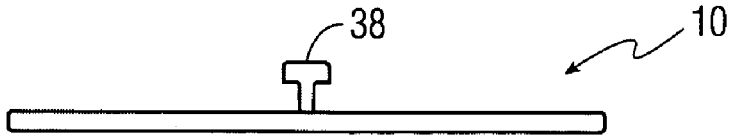
Figure 5A:
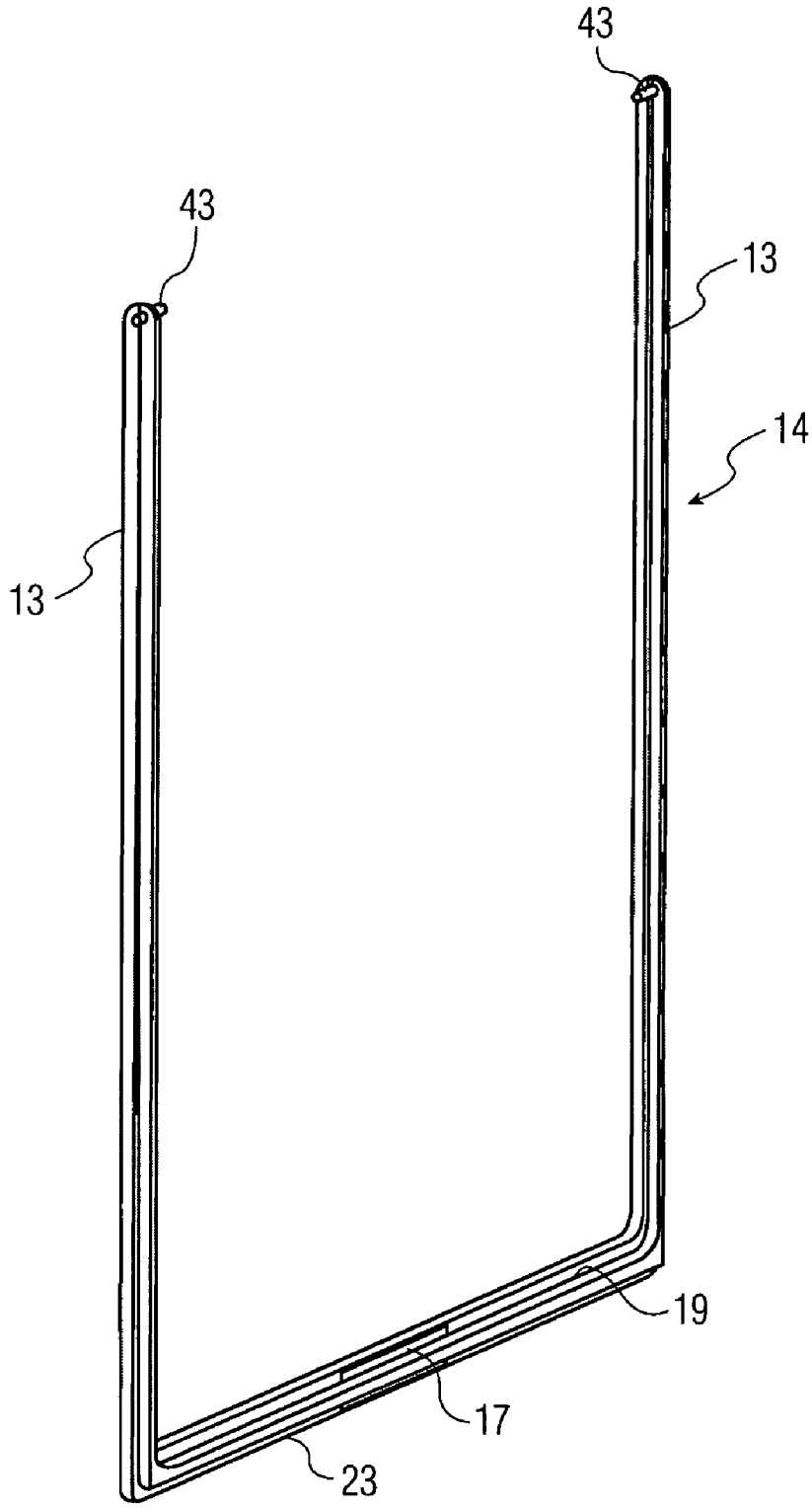
FIGS. 5A through 5F show perspective or pictorial, front elevational, back elevational, left-side elevational (the right-side elevational is a mirror image thereof); top plan, and bottom plan views, respectively, for a flap ring for one embodiment of the invention.
Figure 5B:
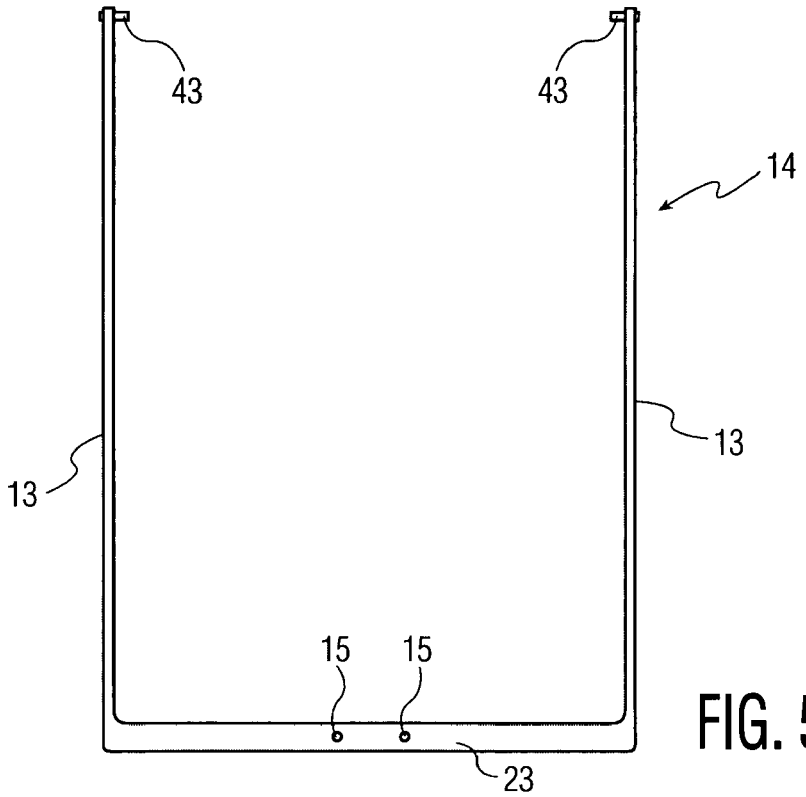
Figure 5C:
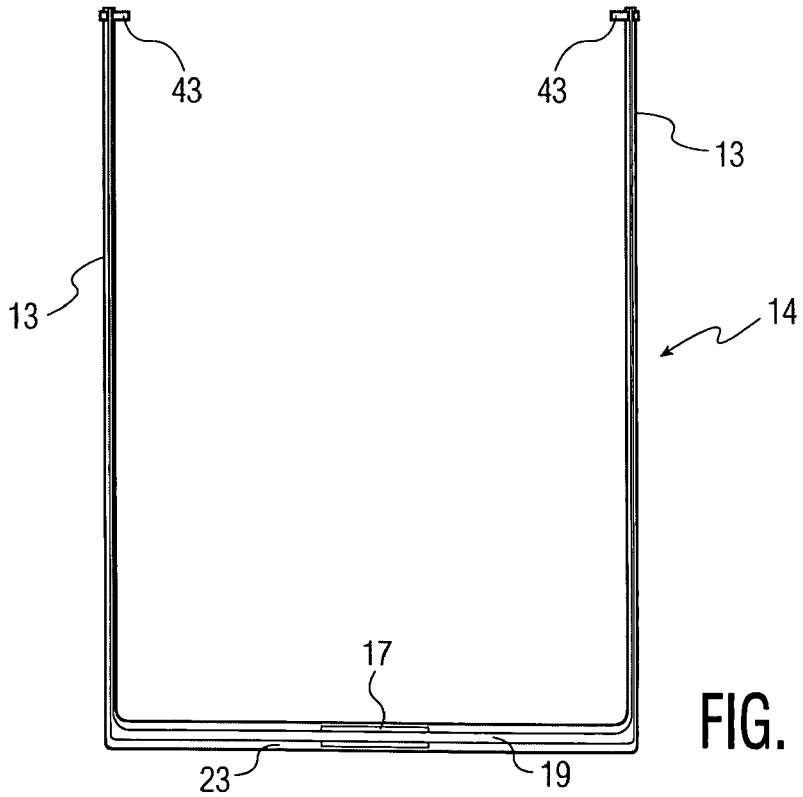
Figure 5D:
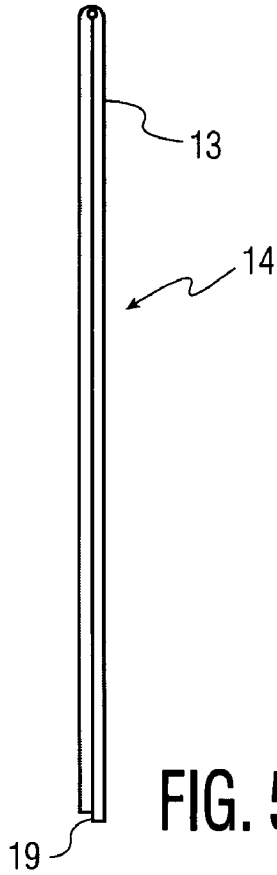
Figure 5E:
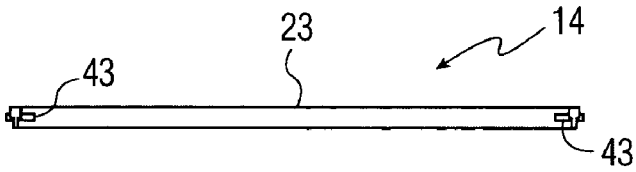
Figure 5F:
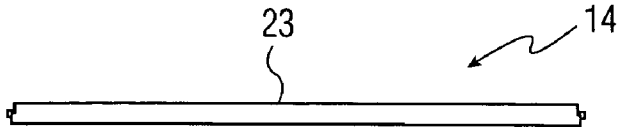
Figure 7:
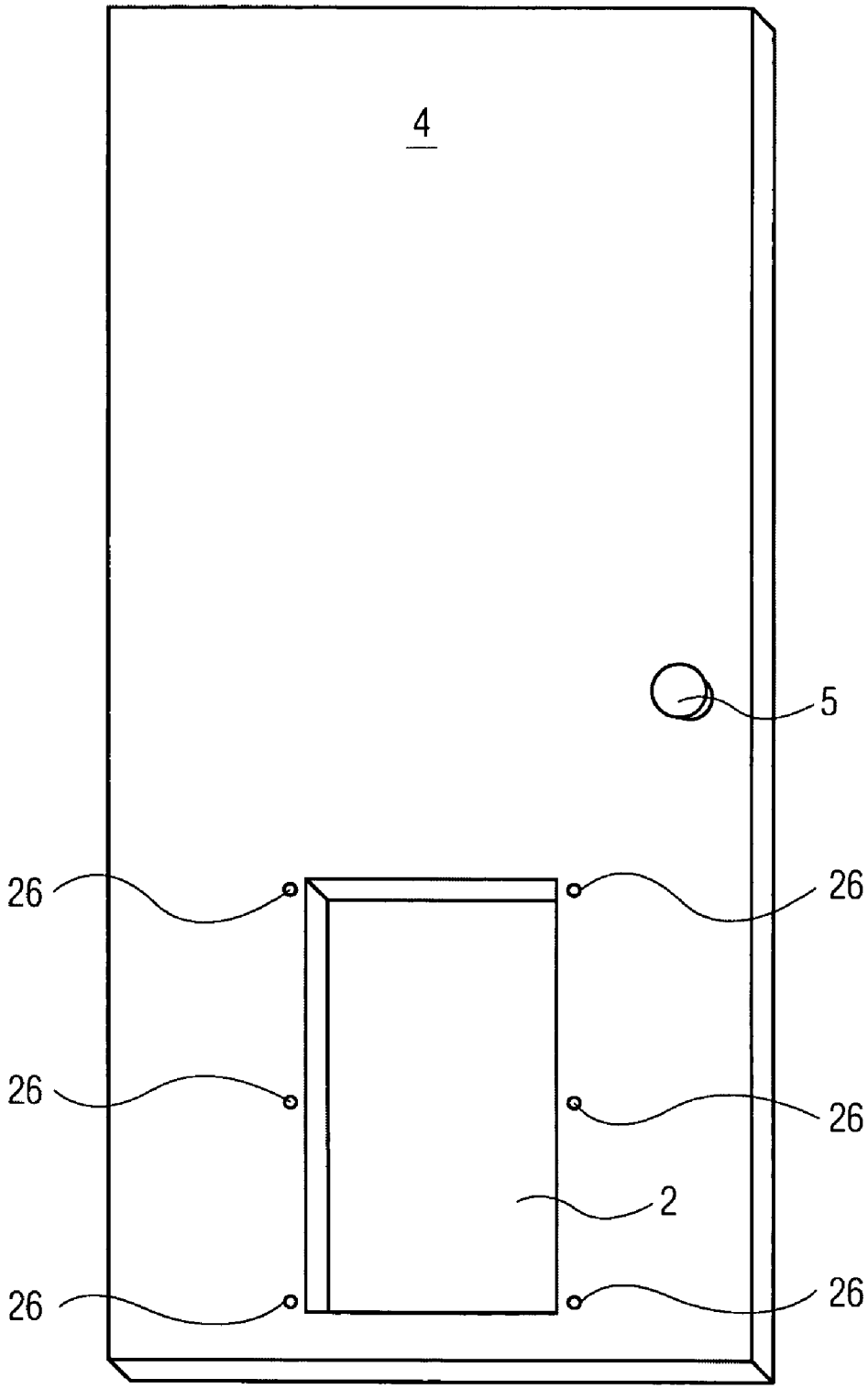
FIG. 7 is a front elevational view of a swinging door having a recessed rectangular hole proximate the bottom thereof for receiving the flap door assembly of the present invention.
Figure 8A:
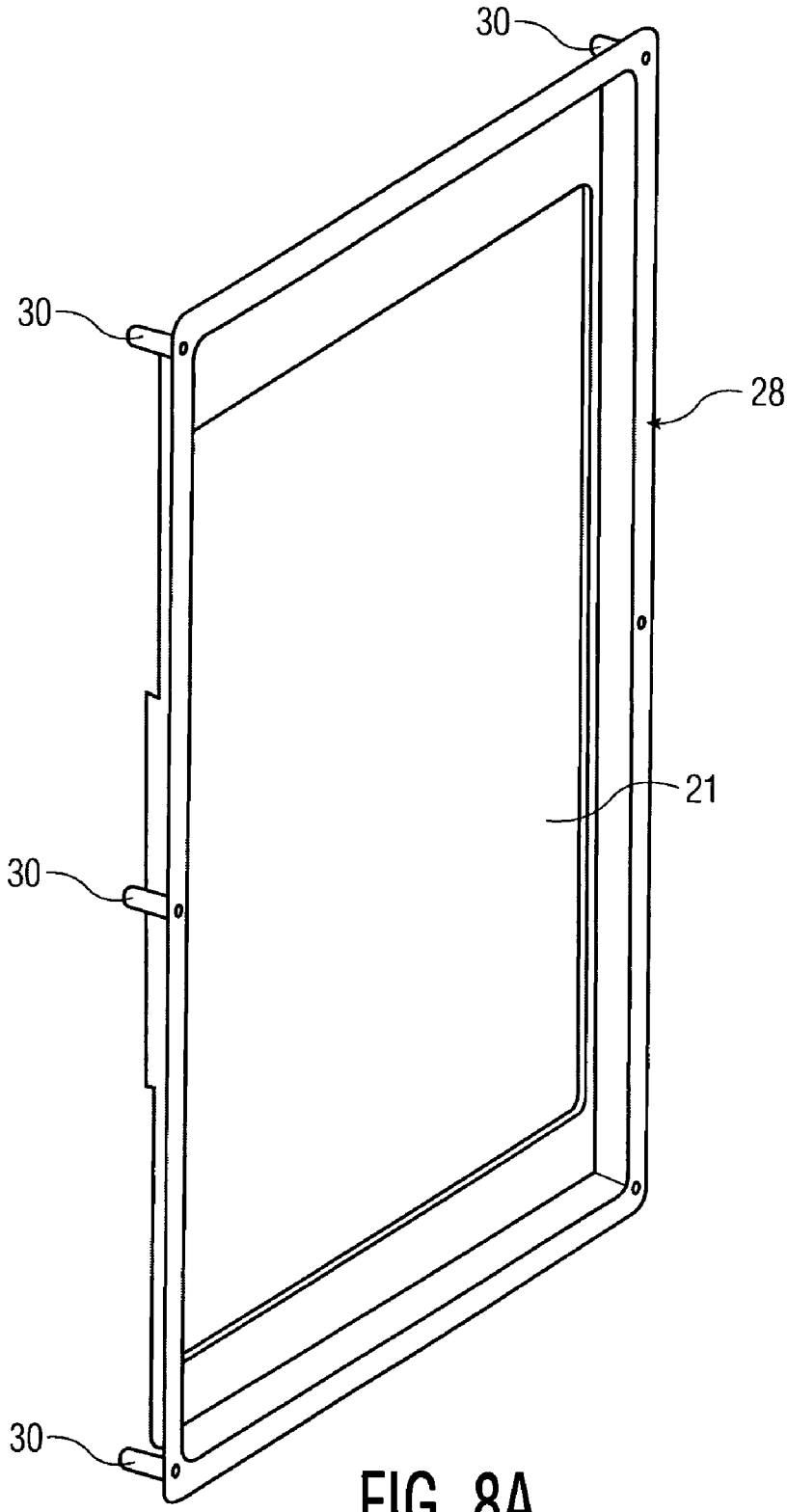
FIGS. 8A through 8E show perspective or pictorial, front elevational, back elevational, right-side elevational (the left-side elevational view being a mirror image), top plan (the bottom plan being a mirror image thereof) views, respectively, for an exterior frame for one embodiment of the invention.
Figure 8B:
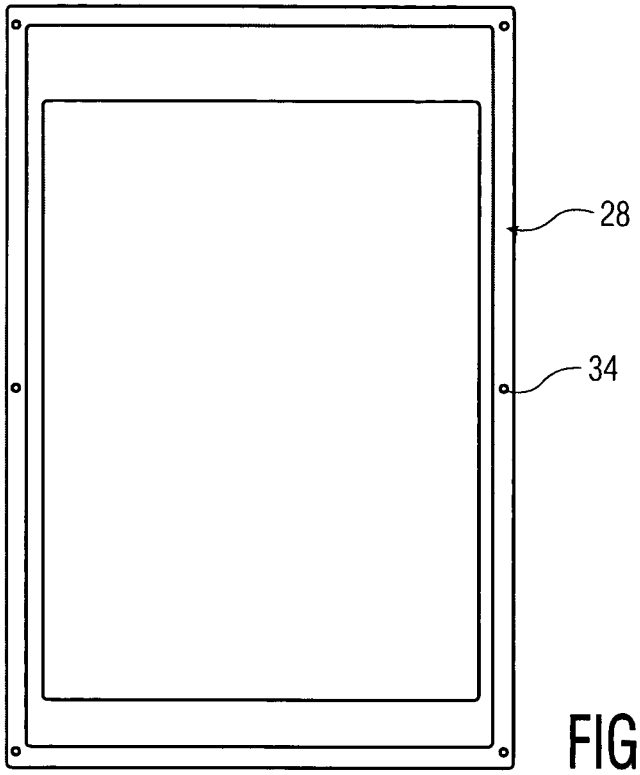
Figure 8C:
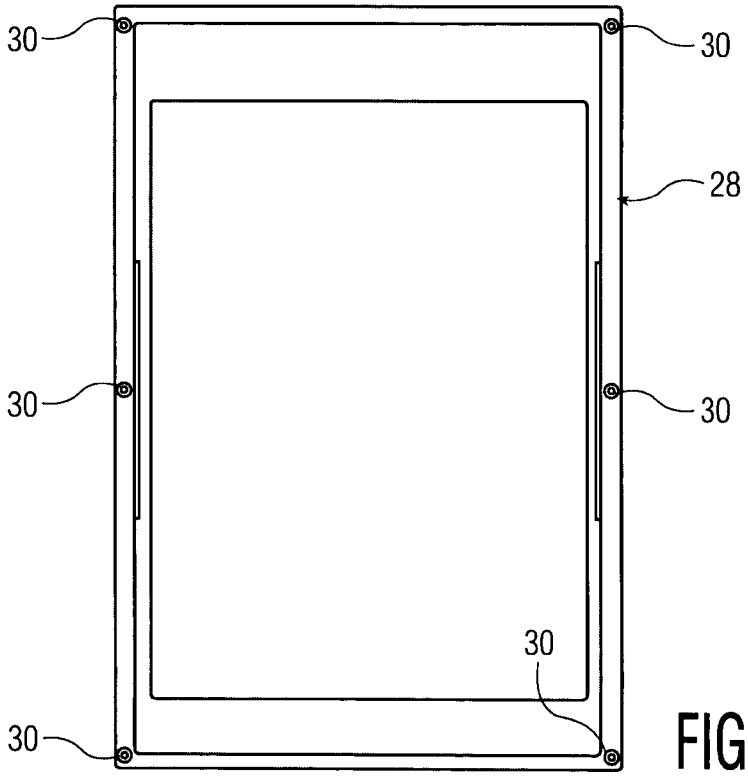
Figure 8D:
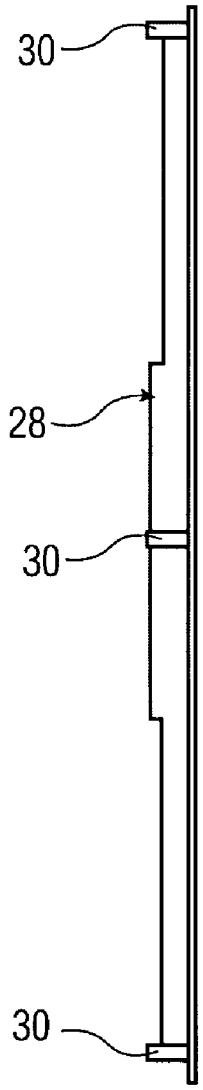
Figure 8E:
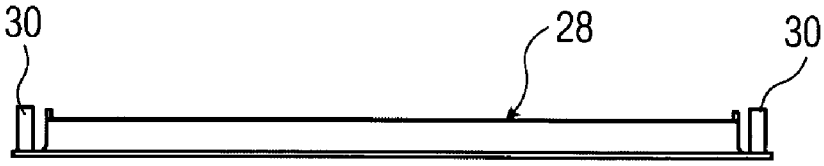

An exploded assembly view is shown in FIG. 1A of the present flap assembly in association with its being mounted into a rectangular hole 2 to cut into a portion of a swinging door 4. The flap assembly can otherwise be mounted within an appropriately sized hole through a wall, or through the bottom portion of any structural or door-like component for providing a pet portal. As will be described in greater detail below, it is first required that the flap assembly components consisting of the interior flap door 6, magnet 8 for interior flap door 6, bezeled locking hinge 10, magnet 12 (snapped into bezeled locking hinge 10), flap ring 14, ferromagnetic metal bar 16 (molded into the flap ring 14), and exterior flap 18, first are assembled together for providing the main assembly of the present flap assembly. Once these components have been assembled together, this main flap assembly 20 is inserted into the cutout portion or rectangular hole 2 of the swinging door 4, in this example, followed by installing the interior frame 22 onto the bezeled handle 38 (as described in detail below), whereafter circular bushings 24 protruding from opposing vertical back edges of interior frame 22 are inserted into predrilled holes 26 (See FIG. 1B) appropriately located about the circumferential vertical sides of the rectangular hole or cutout 2. An exterior frame 28 is mounted onto the exterior side of the door 4 over the rectangular hole or opening 2. Circular bushings 30 protruding from the vertical edges on the back of the exterior frame 28 are pushed into the holes 26 that have been drilled through to the exterior side of the door. Screws 32 (trilobular screws, in this example) are pushed into the bushing holes 34 on the front of the interior frame 22, and screwed into the bushings 30 of the exterior frame 28, for completing the mounting of the flap assembly into the swinging door 4, in this example. After the screws are tightened, the present flap assembly is ready for operation, as will be described below. Note that FIG. 1B is a side view showing the final installation of the present flap assembly 20 via installation of the interior frame 22 and exterior frame 28 onto the door with the flap assembly 20 therebetween. Also FIG. 7 shows the preparation of a swinging door 4 for receiving the flap assembly, interior frame 22 and exterior frame 28. Note in this example, the rectangular hole 2 through door 4.

FIGS. 2A through 3E show the design of the interior frame 22. As described further below, the interior frame 22 includes circular bushings 24, a rectangular hole 25, screw holes 34, and a rectangular open slot 52.

Figure 6A:
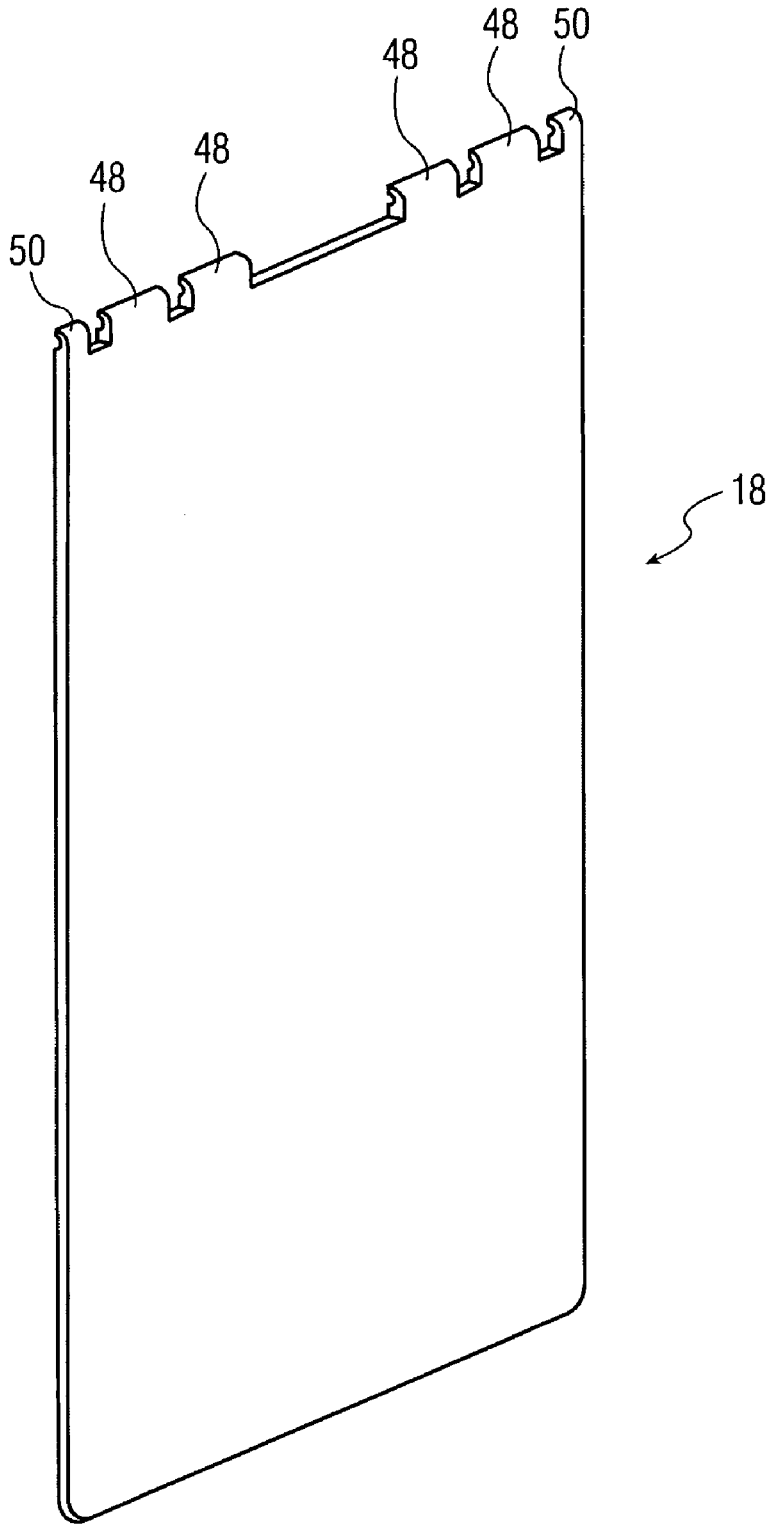
FIGS. 6A through 6F show perspective or pictorial, front elevational, back elevational, right-side elevational (the left-side elevational being a mirror image), top plan, and bottom plan views, respectively, for an exterior flap for one embodiment of the invention.
Figure 6B:
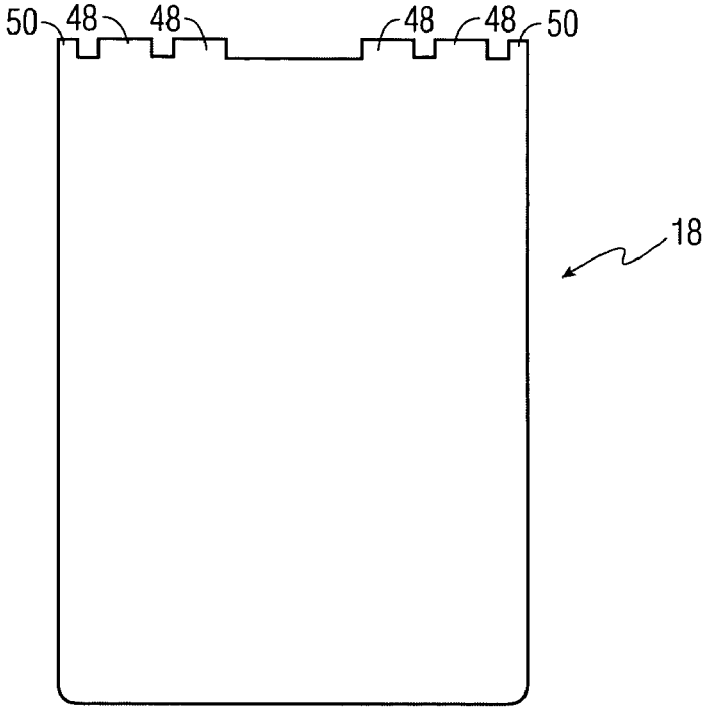
Figure 6C:
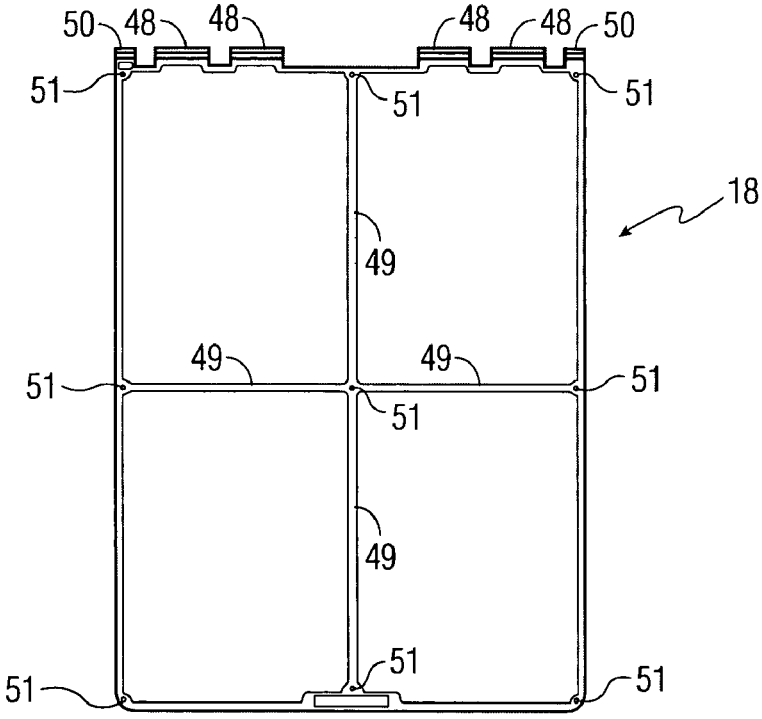
Figure 6D:
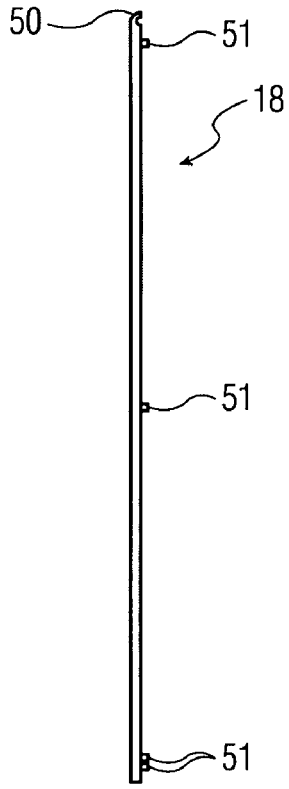
Figure 6E:
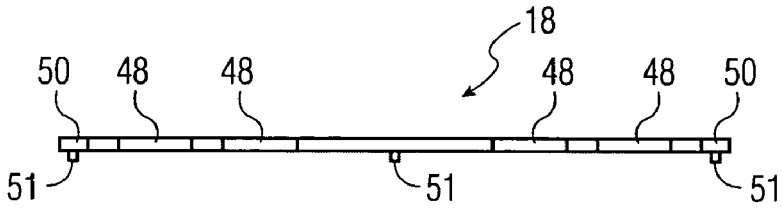
Figure 6F:
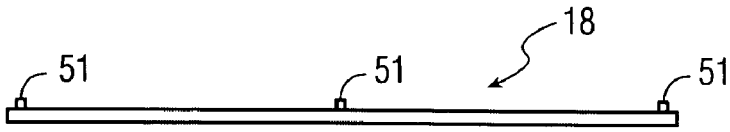

FIG. 3A through 3F show the design of the interior flap door 6. As described further below, the design includes mounting hinges 42, hinge pockets 46, and blind holes 45 for receiving securement tabs 51 of exterior flap 18 (see FIGS. 6C and 6D) to secure the two together.

FIGS. 4A through 4E show design details for the bezeled locking hinge 10. As described further below, the associated design includes a rectangular opening 39, a recessed pocket 11, a bezel handle 38, and hinge rods 44.

FIGS. 5A through 5F show the design for the flap ring 14. As described further below, the associated design includes hinge posts 43, a recessed pocket 17, a lower inwardly directed step 27, and an upper inwardly directed step 19 across its cross member 23 and inner portion of its opposing vertical arms 13.

FIGS. 6A through 6F show design details for the exterior flap 18. As described further below, the associated design includes mounting hinges 48, strengthening ribs 49, hinge pockets 50, and, securement tabs 51.

FIG. 7 shows a pictorial view of swinging door 4 into which a rectangular hole 2 has been cut for receiving the present flap assembly 20. The hole 2 receives interior frame 22 on the interior side, and exterior frame 28 on the exterior side, respectively. Bushing holes 26 are included, as shown.

FIGS. 8A through 8E show details of the design of the exterior frame 28. As described further below, exterior frame 28 includes a rectangular opening 21, and circular bushings 30.

Figure 9:
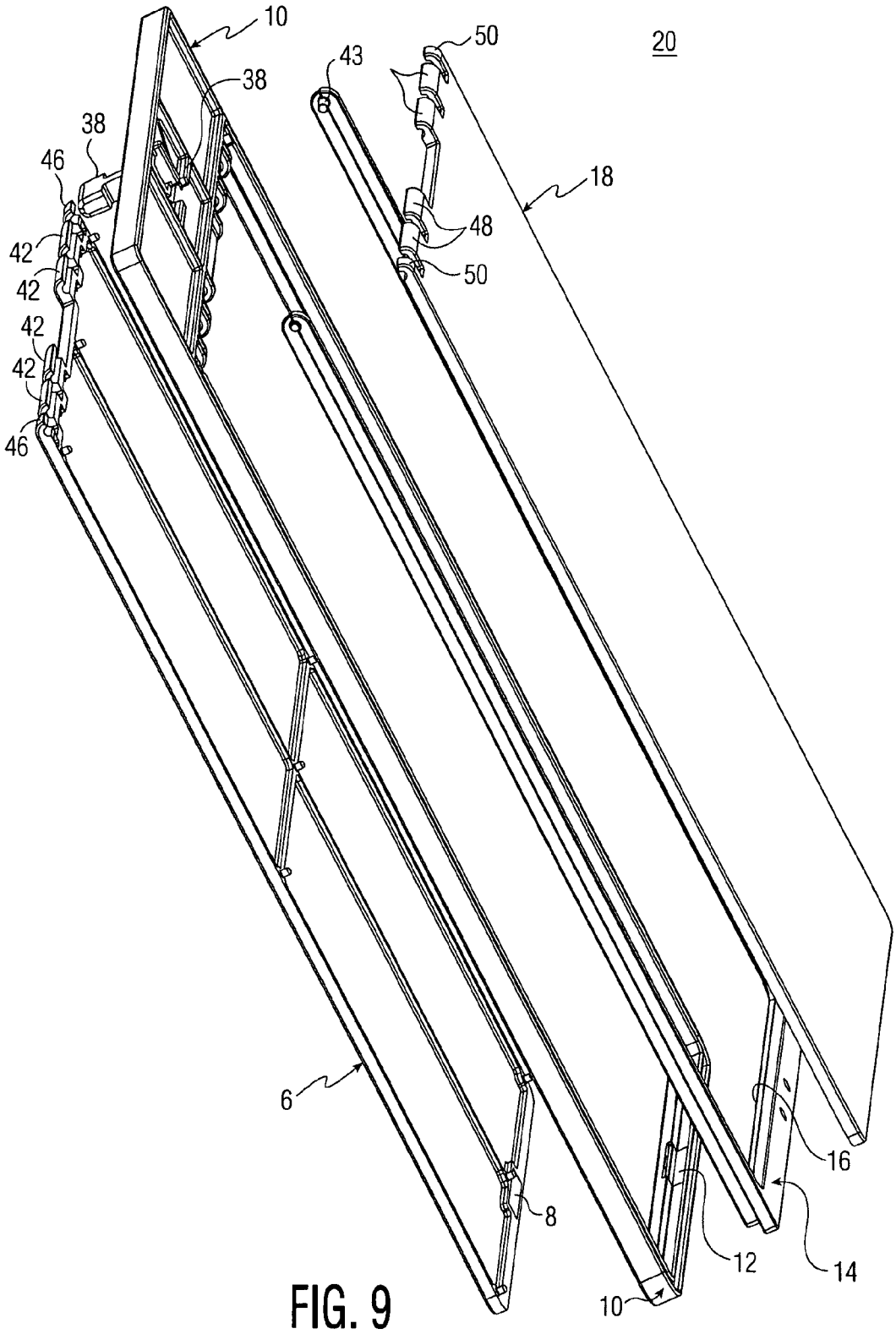
FIG. 9 shows an exploded assembly view of a hinge-flap assembly for one embodiment of the invention.

An exploded assembly view of the hinge-flap assembly 20 is shown in FIG. 9. As previously indicated, as shown, the main hinge-flap assembly 20 includes the exterior flap 18, flap ring 14, bezel locking hinge 10, and interior flap 6. Note that interior flap 6 is longer and wider than exterior flap 18, whereby when the two are joined together, the bottom and side portions of the interior flap 6 extend beyond bottom and side portions of exterior flap 18, forming an inwardly directed step from the side and bottom portion of the exterior flap 18 to the interior flap 6 (see FIG. 24). Also note the installation of the flap magnet 8 in the interior flap 6, the installation of the magnet 12 in the bezel locking hinge 10, and the installation of the ferromagnetic metal bar 16 in the flap ring 14. The metal bar 16 can be molded into the flap ring 14, or otherwise secured thereto, for example. As will be described in greater detail below, through use of the ferromagnetic bar 16, the magnet 8, and flap ring magnet 12, proper alignment for weather sealing the interior and exterior flaps 6, 18, respectively, with the flap ring 14 and bezel locking hinge 10, and allows the flaps 6, 18 to be moved downward from an uppermost location to either of two lower locations through operation of the bezel handle 38, as will be described in detail below.

Figure 10:
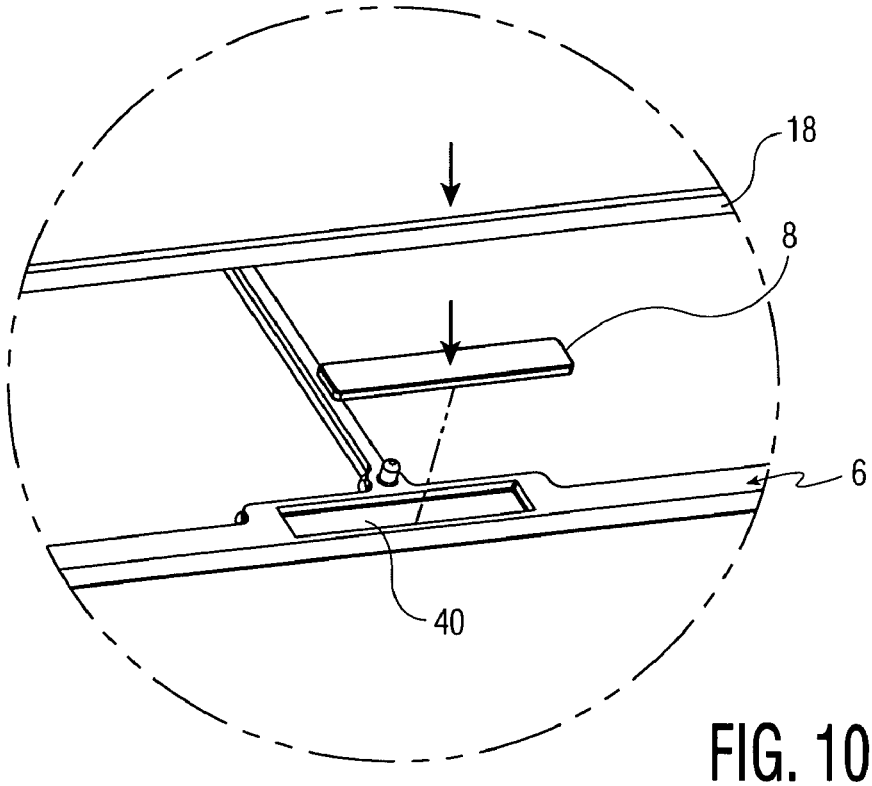
FIG. 10 shows an enlarged view of the initial assembly of a magnet into an interior magnet pocket of an interior flap for an embodiment of the invention.
Figure 11:
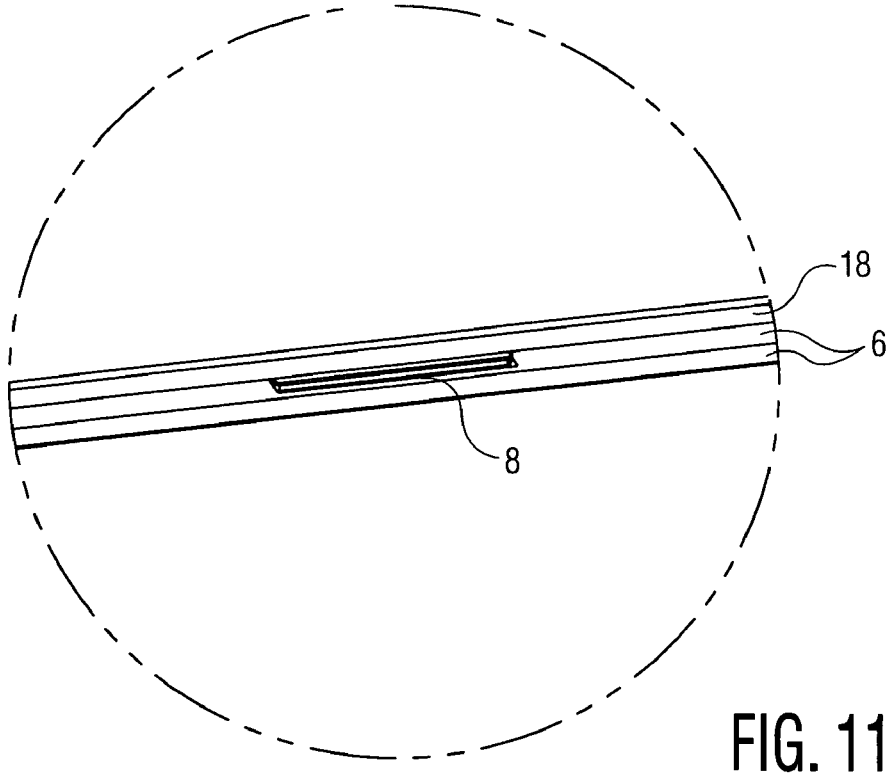
FIG. 11 shows an enlarged view of the magnet of FIG. 15 being held within the pocket of the interior flap via a "sandwiching" of the interior and exterior flaps for an embodiment of the invention.
Figure 12:
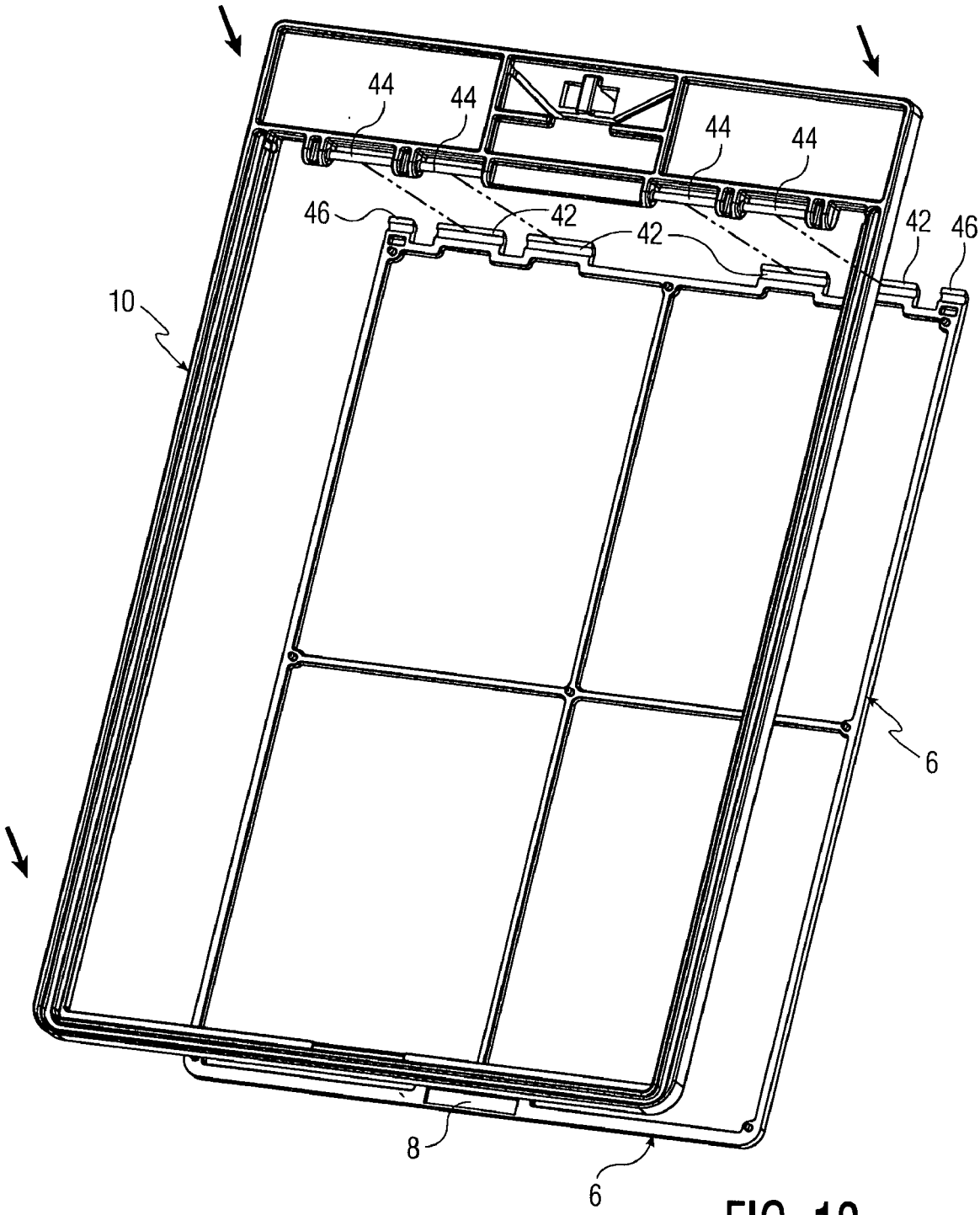
FIG. 12 shows an exploded assembly view of a first stage for assembling the present hinged-flap assembly for an embodiment of the invention.
Figure 13:
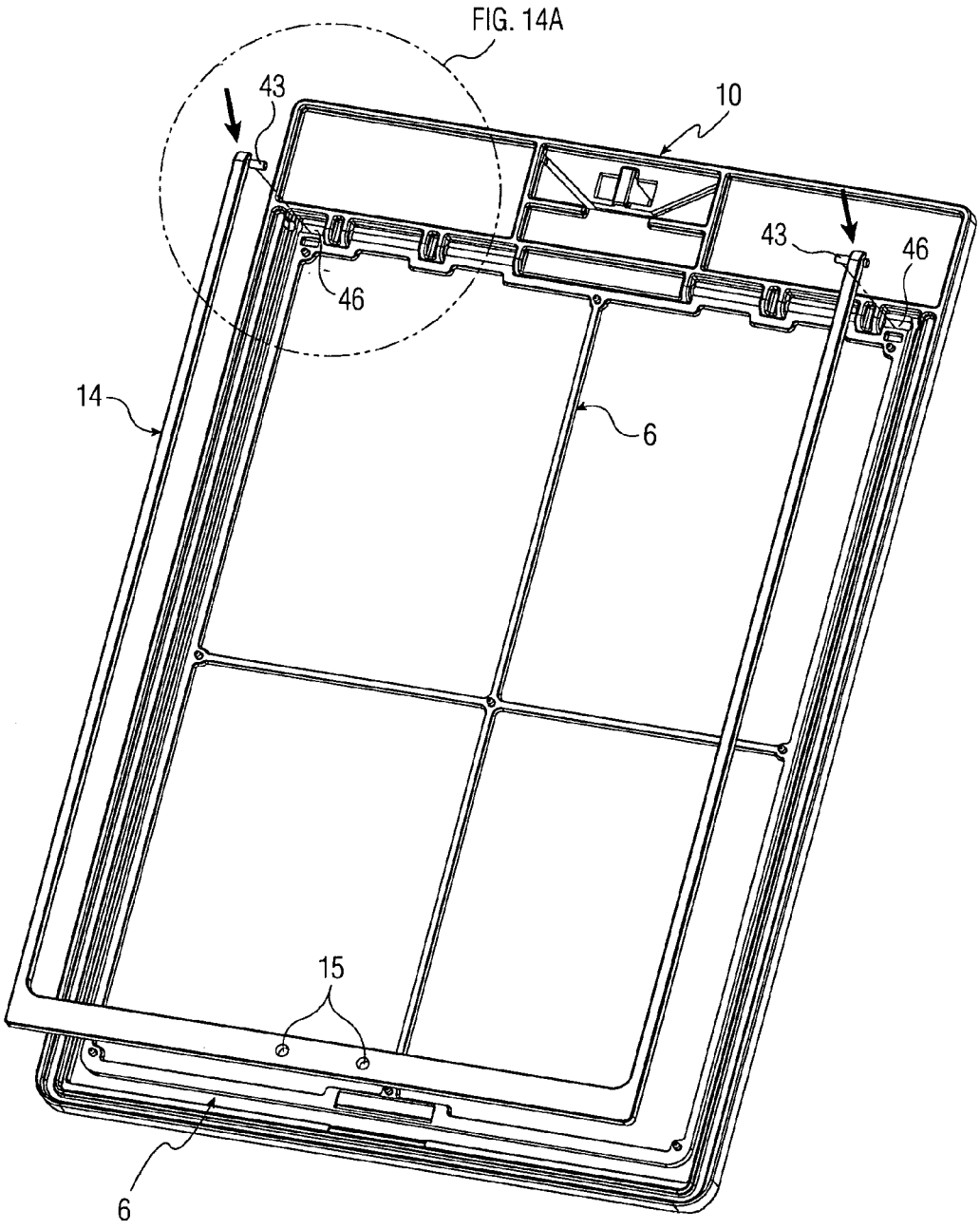
FIG. 13 shows an exploded assembly view for a second stage of assembling the present flap assembly.
Figure 14A:
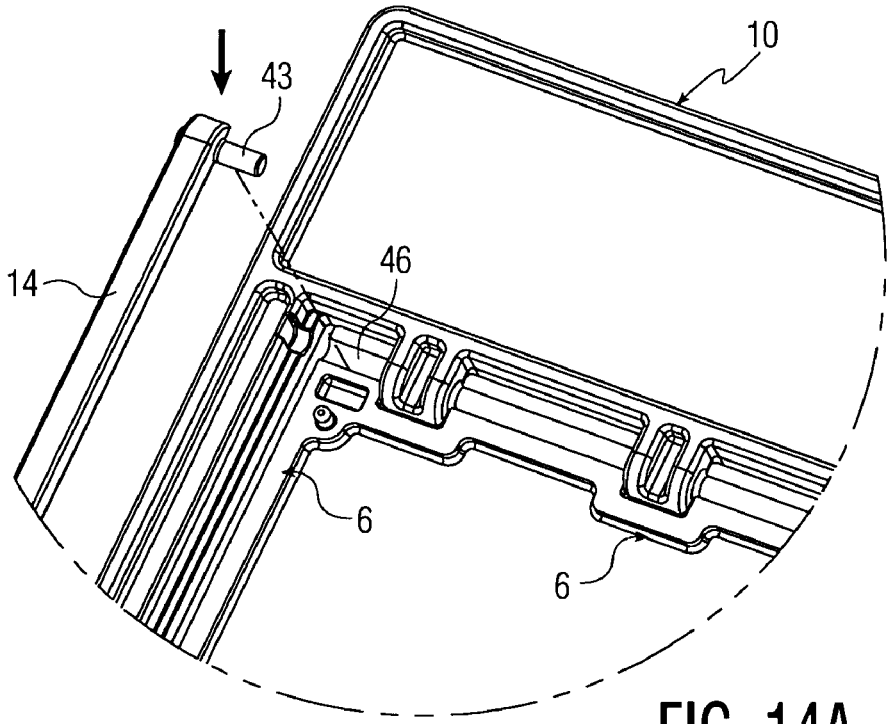
FIG. 14A is a detailed view showing an exploded assembly view of the insertion of a post on the flap ring just prior to insertion into pockets located in the interior flap door.
Figure 14B:
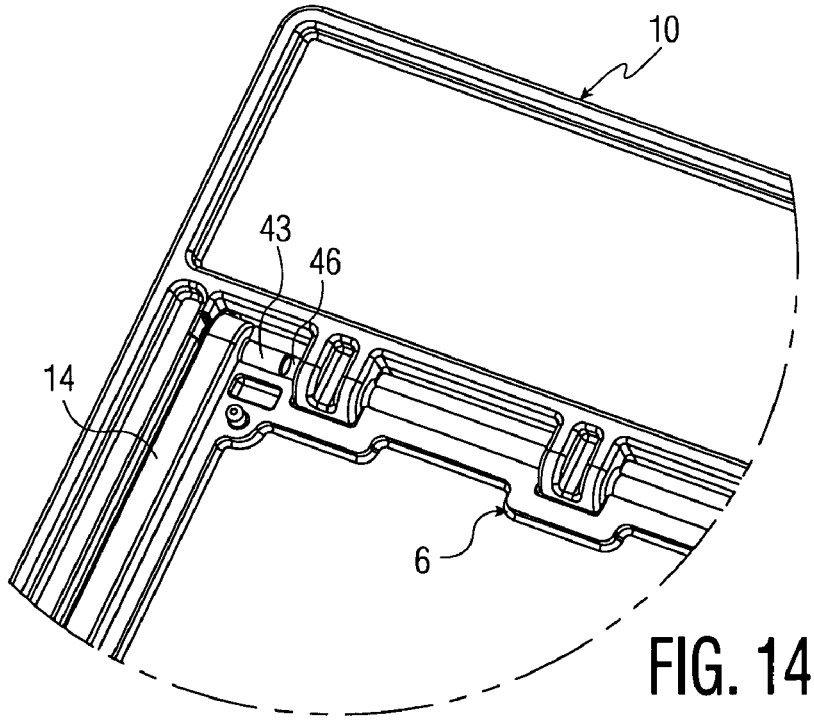
FIG. 14B shows an enlarged view of a portion of the completed assembly of the flap ring into the bezeled locking hinge and interior flap door for an embodiment of the invention.
Figure 15:
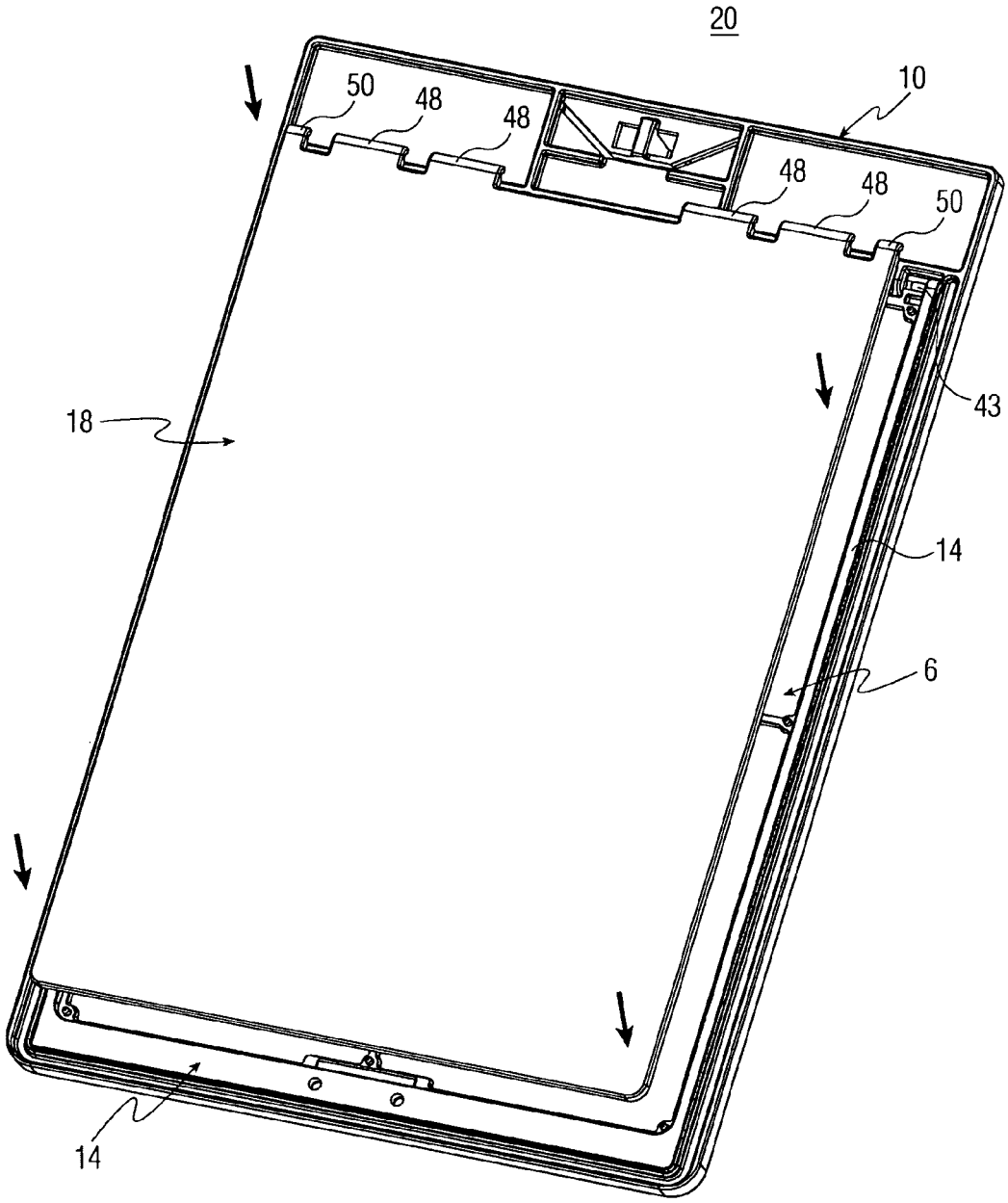
FIG. 15 shows an exploded assembly view of the assembly of the exterior flap into the previously assembled bezeled locking hinge with interior flap and flap ring assembly, for an embodiment of the invention.
Figure 16:
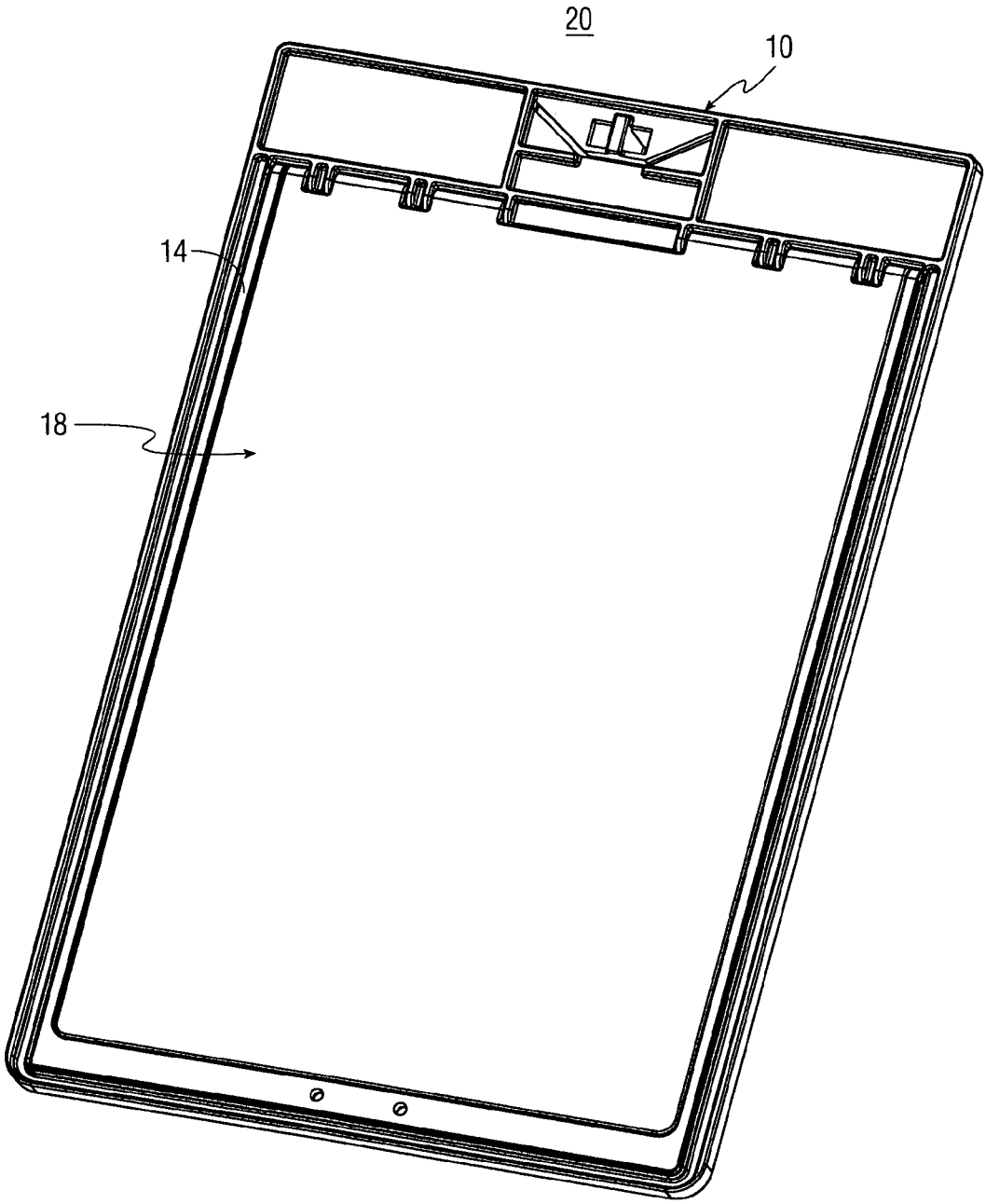
FIG. 16 is a pictorial view showing an exterior of the completed hinge-flap assembly for an embodiment of the invention.

In FIG. 10, a detailed view is shown of the installation of the flap magnet 8 into an interior magnet pocket 40 in the lower portion of the interior flap or flap door 6. As further shown in detail in FIG. 11, after assembly of the exterior flap 18 to the interior flap 6, the flap magnet 8 is sandwiched therebetween. However, prior to the "sandwiching" of magnet 8 between the interior and exterior flaps, as shown in FIG. 12, with the interior flap magnet 8 installed in the pocket 40 of flap 6, the interior flap 6 mounting hinges 42 are pushed onto the integral hinge rods 44 located as shown in the upper portion of the bezel rocking hinge 10. Following this operation, the flap ring 14 has its hinge post 43 mounted into hinge pockets 46 of the interior flap 6. FIG. 14A shows a detailed view of the installation of the left-hand hinge post 43 into its associated hinge pocket 46 of interior flap 6 (see FIG. 12). A detailed view of this installation on the left-hand portion of FIG. 13 is shown in FIG. 14A, with the completed installation shown in the detailed view of FIG. 14B. Next, the exterior flap 18 is installed on the other side of the bezel locking hinge 10, as shown in FIG. 15. The exterior flap mounting hinges 48, along with its hinge pockets 50 are snapped onto the exterior half portions of the hinge post 44 of the bezel locking hinge 10, and the exterior halves of the hinge posts 43 of the flap ring 14. The exterior or back of the completed hinge-flap assembly 20 is shown in FIG. 16.

Figure 17A:
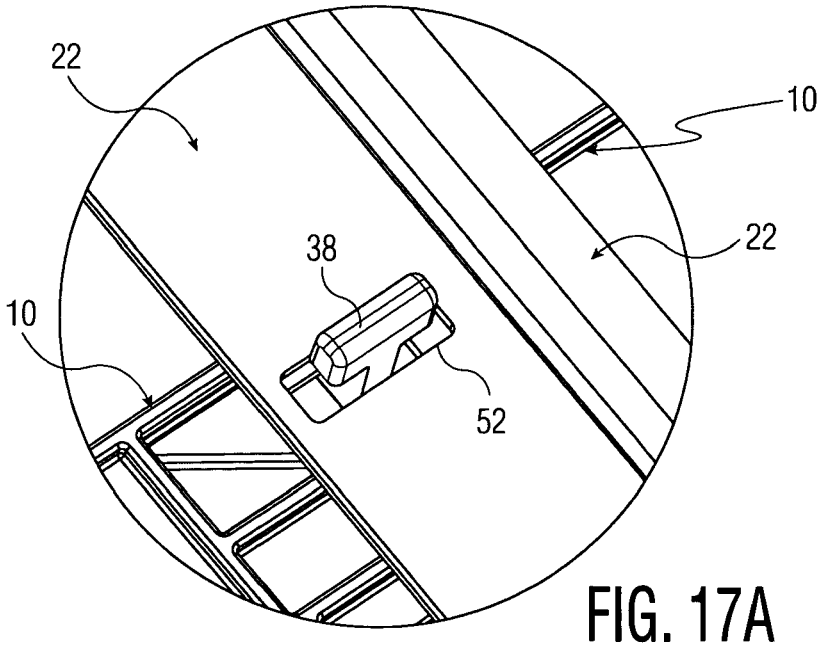
FIGS. 17A and 17B show the installation of the interior frame to the hinge-flap assembly for an embodiment of the invention.
Figure 17B:
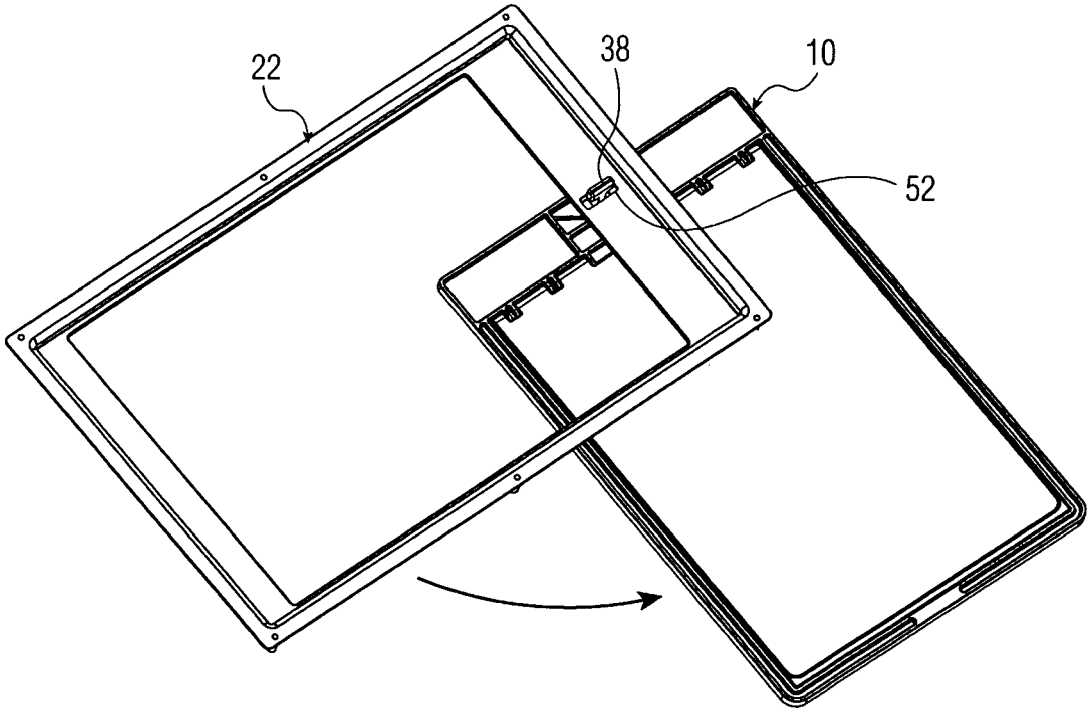
Figure 17C:
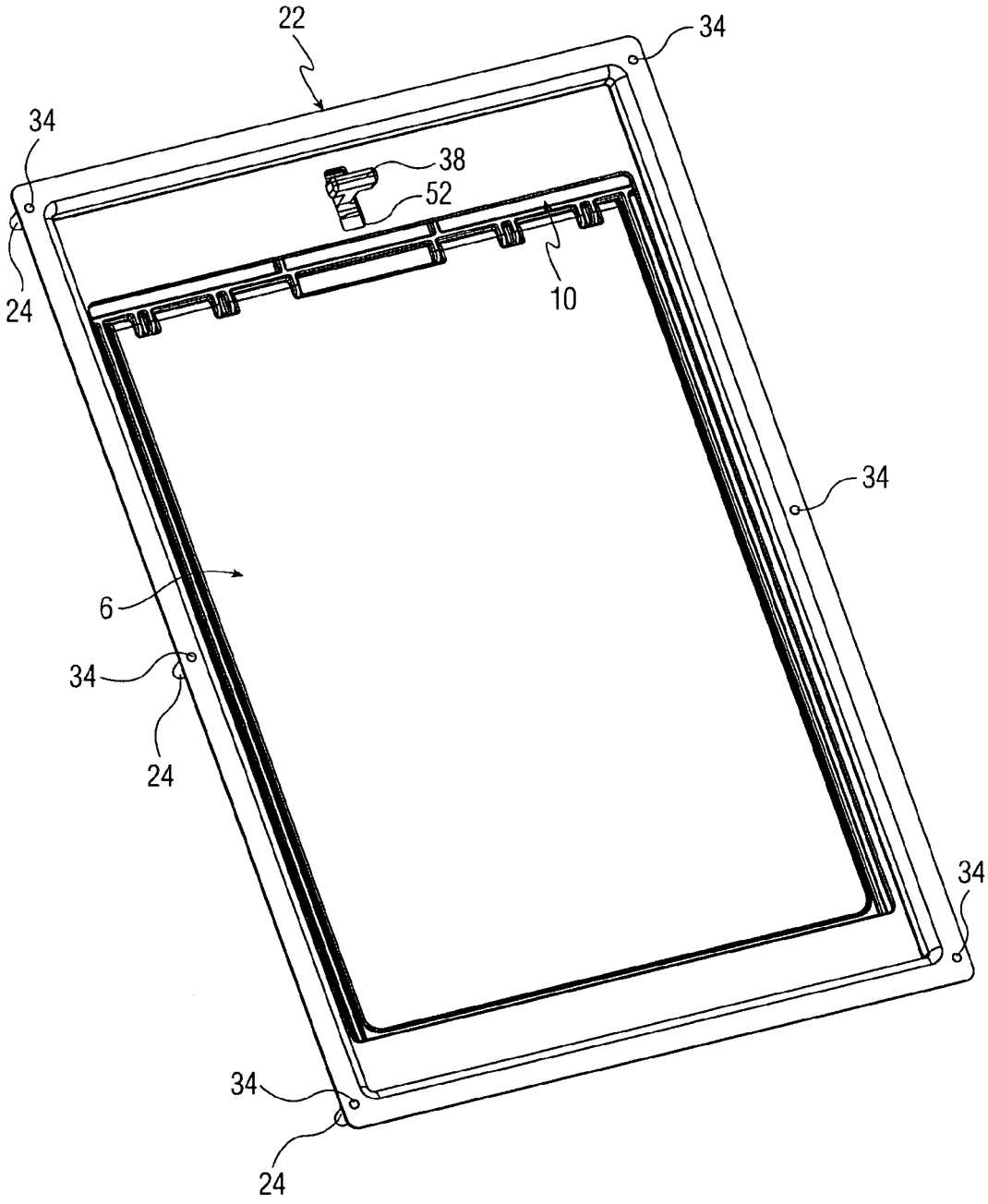
FIG. 17C shows the completed installation of the interior frame to the flap assembly.

The next operation is to install the interior frame 22 onto the flap assembly 20. As shown in the detailed view of FIG. 17A, it is necessary to align the rectangular open slot 52 of the interior frame 22 with the bezel handle 38 of the bezel locking hinge 10. Further reference to the pictorial diagram of FIG. 17B, the interior frame 22 is then rotated, in this example, counterclockwise to complete the interior frame 22 installation as further shown in FIG. 17C.

Figure 18A:
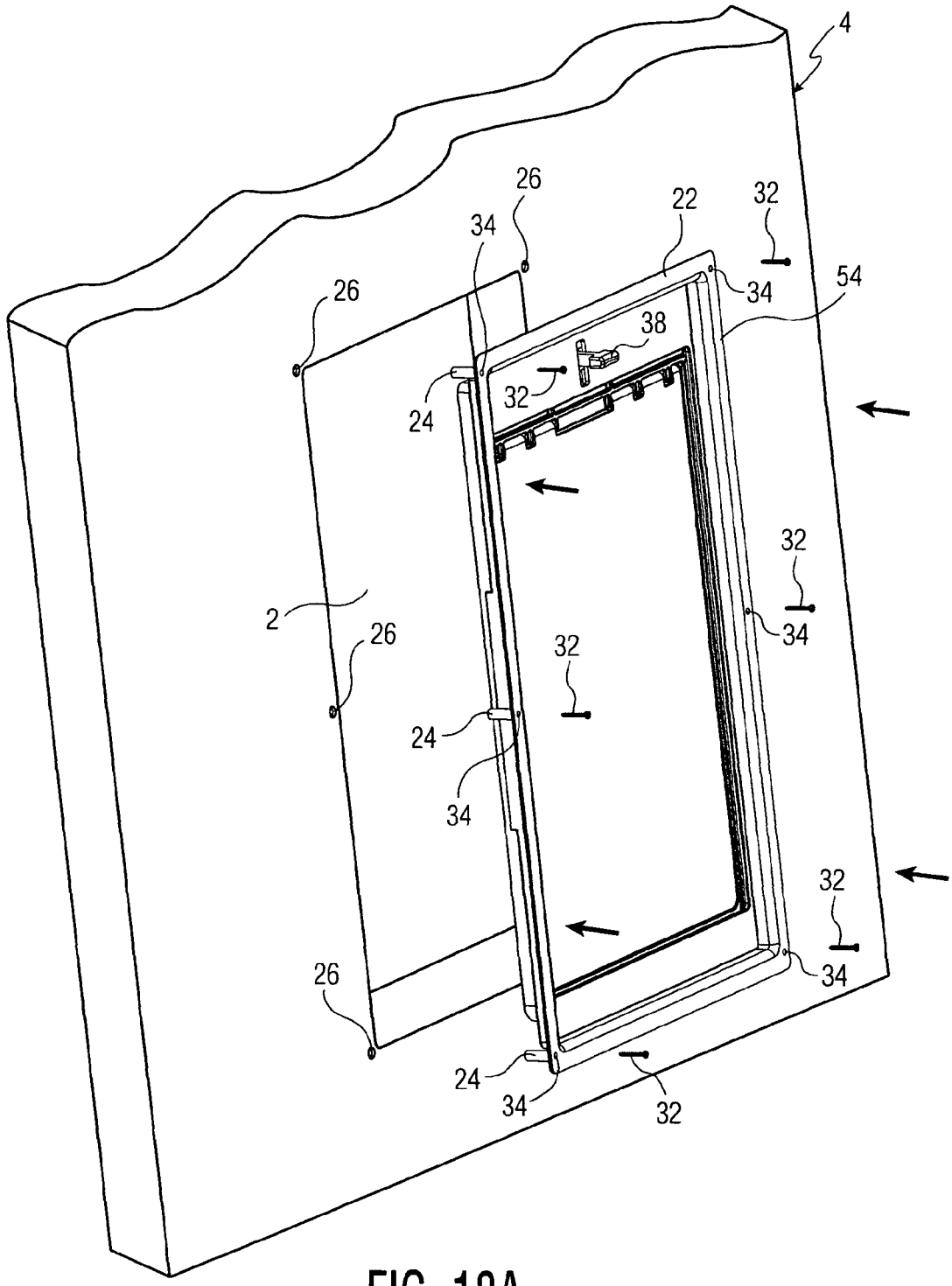
FIG. 18A is an exploded assembly diagram showing the installation of the flap assembly into a recessed hole in a swinging door, for example.
Figure 18B:
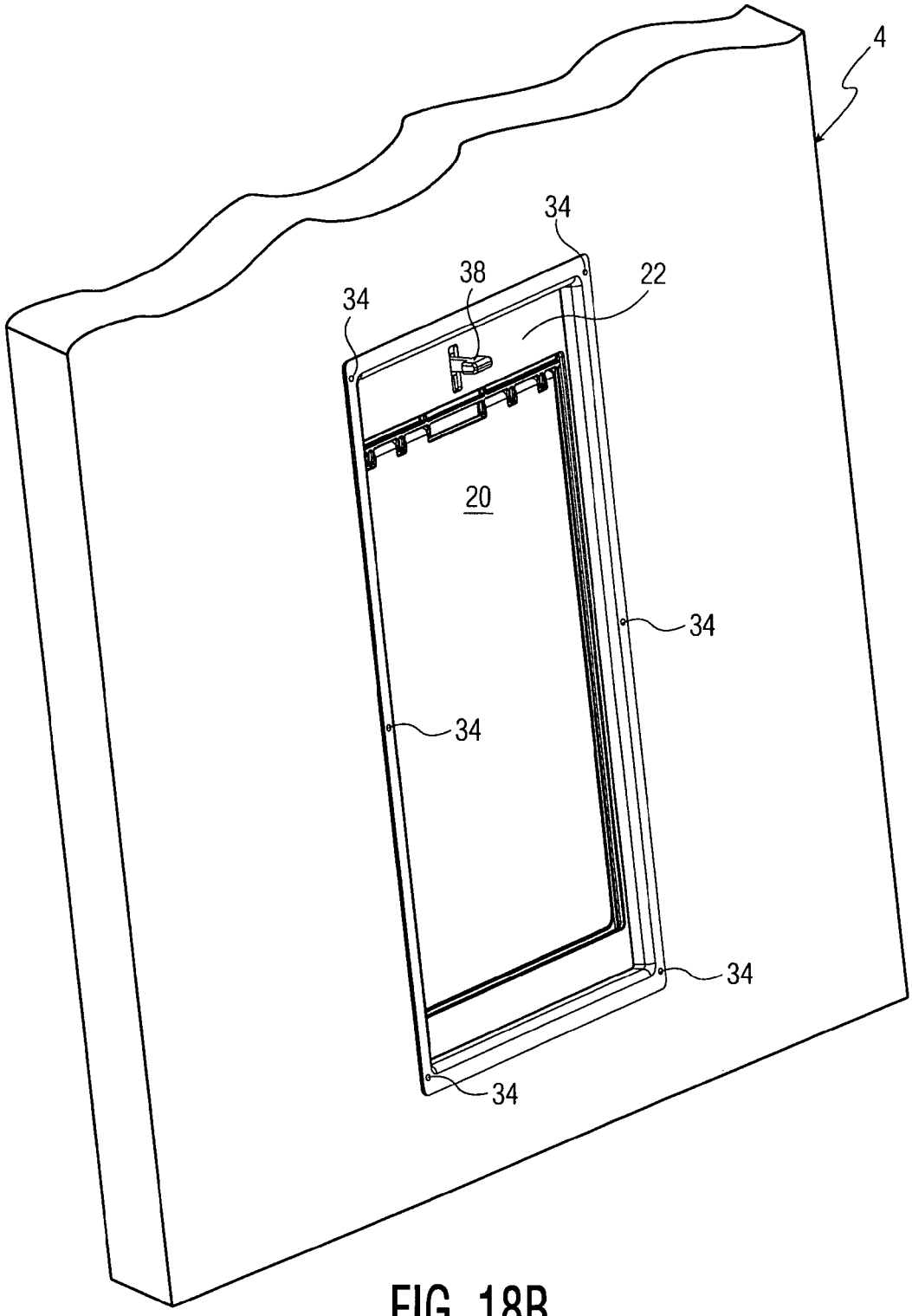
FIG. 18B shows the completed installation of the flap assembly in the front or interior side of a swinging door.

The hinge-flap assembly 20 with the interior frame 22 installed thereon, is now ready for installation into an appropriately sized throughhole or opening such as previously illustrated for swinging door 4, but not limited thereto as previously explained. An example of such installation onto a swinging door 4 is shown in FIG. 18A. First, the frame assembly 54 of interior frame 22 and flap assembly 20 is mounted into a rectangular hole 2 with the circular bushings 24 of interior frame 22 being pushed into the predrilled holes 26 through swinging door 4 proximate hole 2. This partially completed assembly is shown in FIG. 18B.

Figure 19:
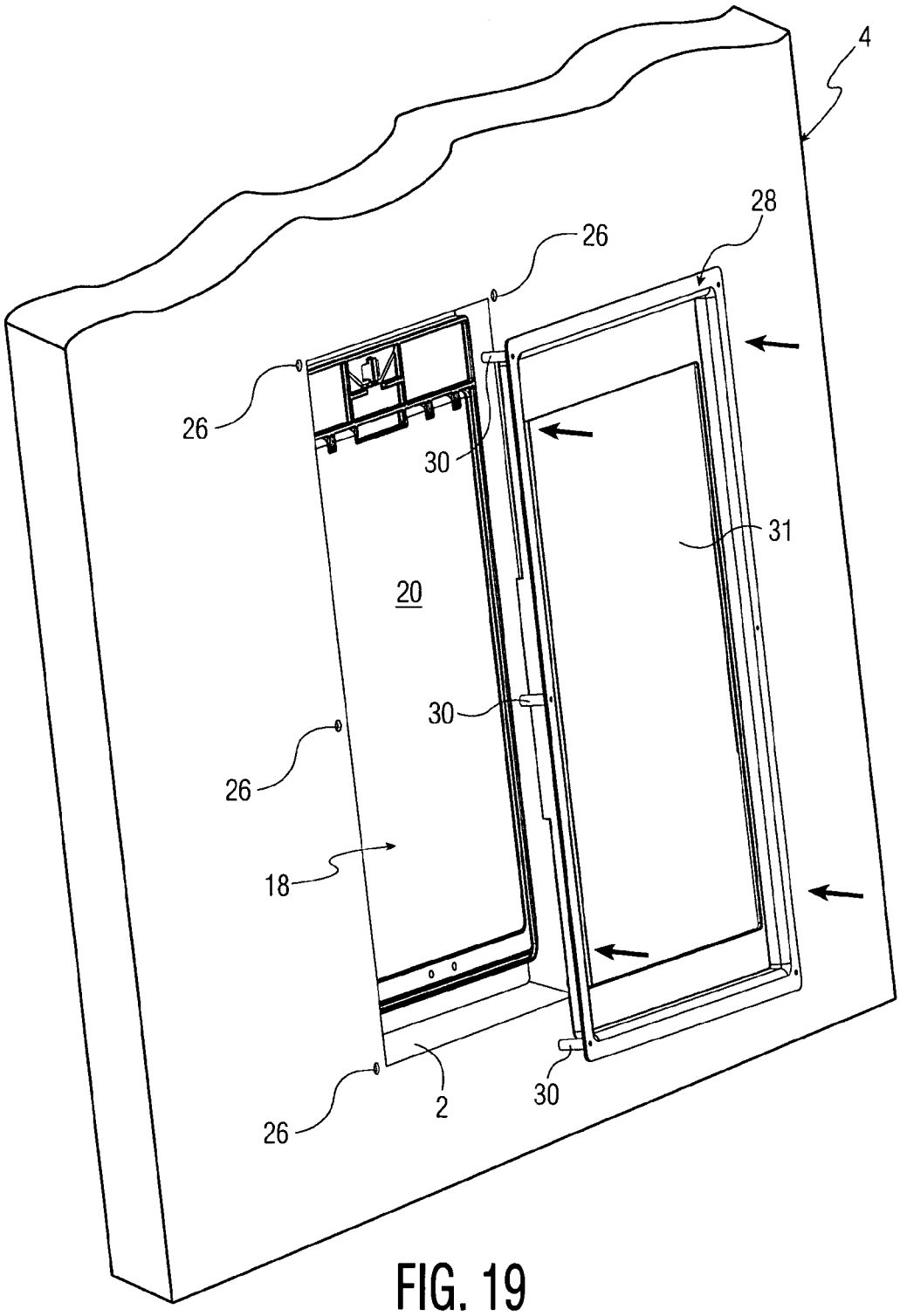
FIG. 19 shows an exploded assembly view of the installation of the exterior frame to the back of the interior frame assembly on the exterior side of the swinging door.
Figure 20:
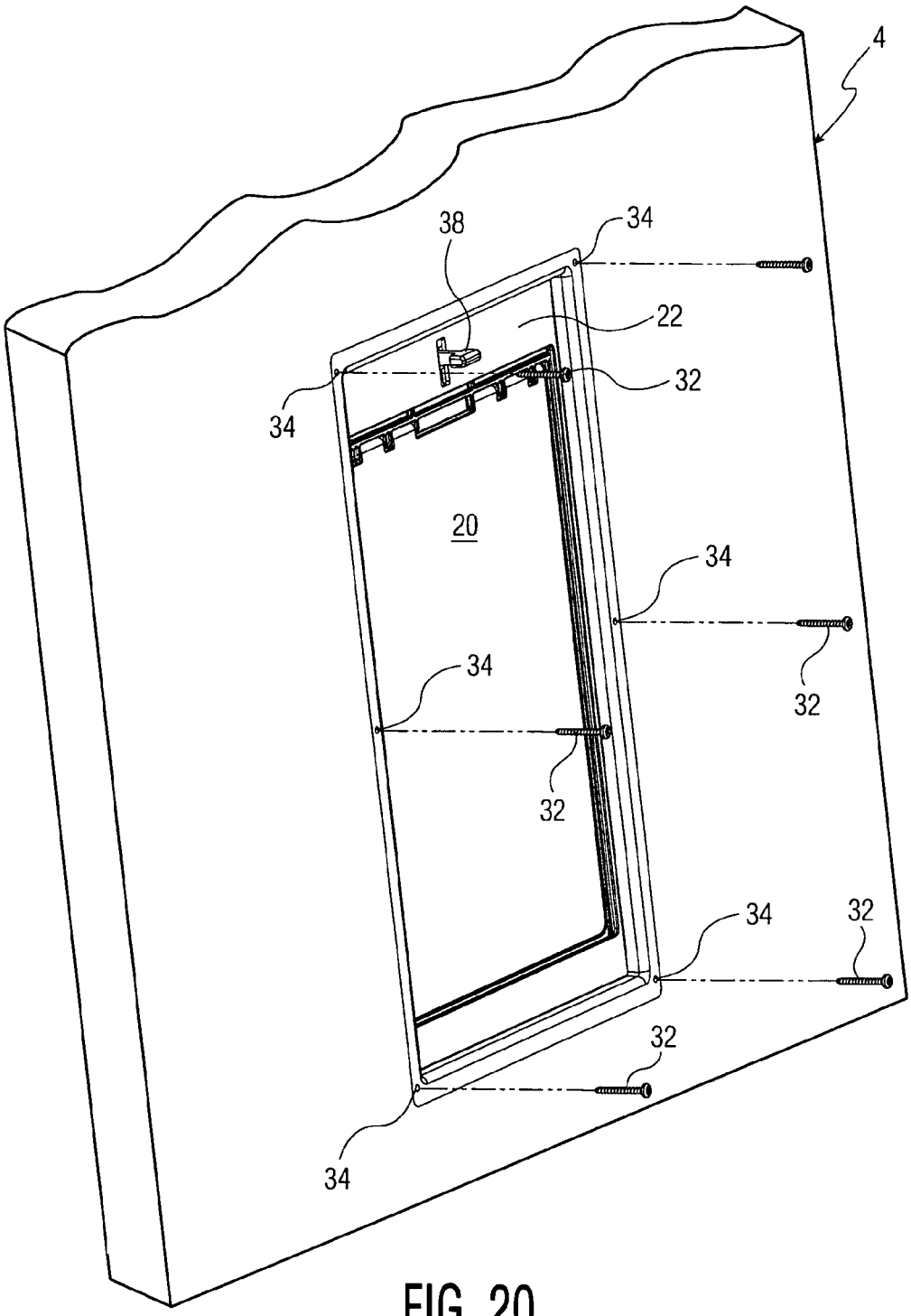
FIG. 20 shows a pictorial view of the interior frame receiving screws for rigidly securing it to the exterior frame with the flap assembly secured therebetween in the swinging door.
Figure 21:
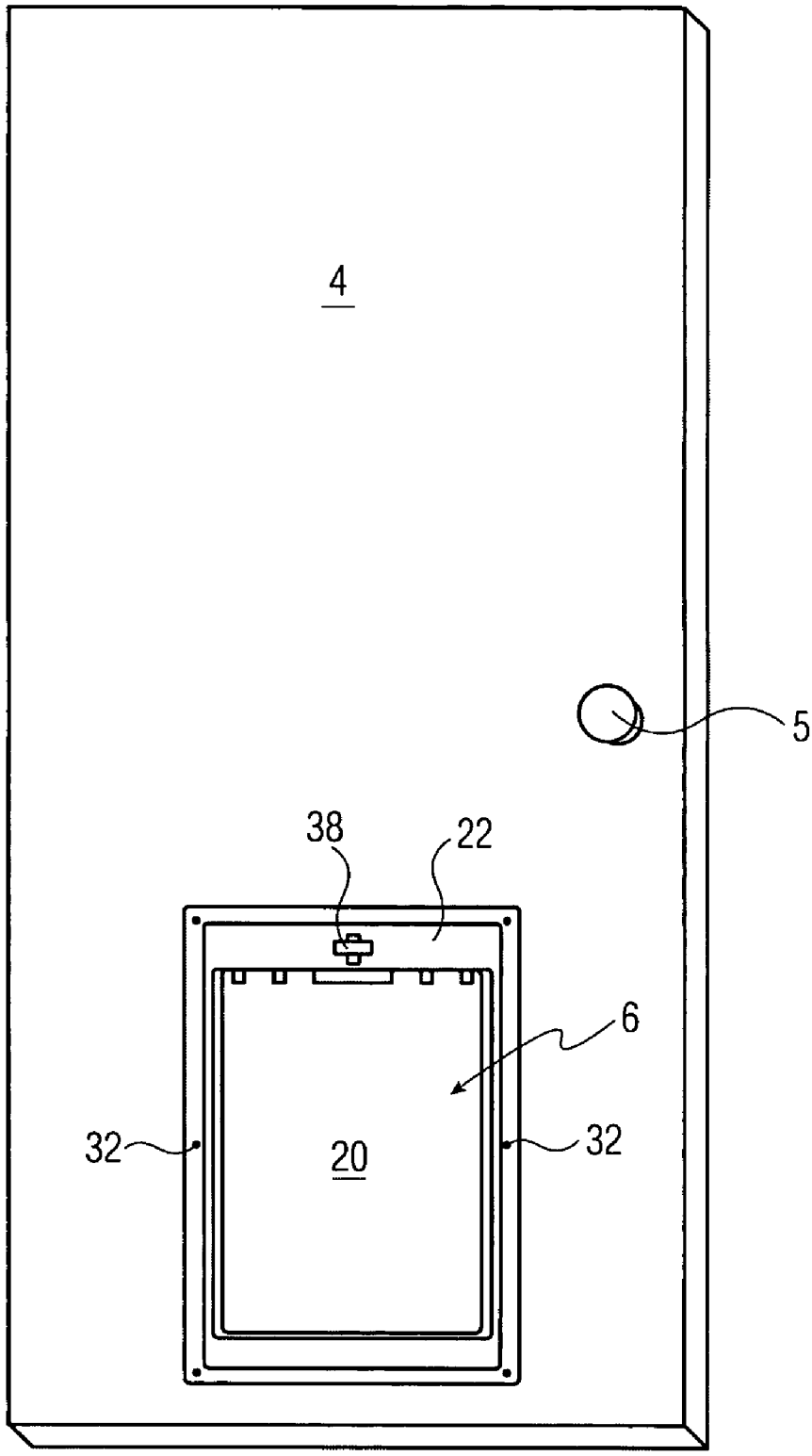
FIG. 21 shows a pictorial view of the interior frame and flap assembly as installed in a swinging door, for example.

The next operation is to install the exterior frame 28 into the rectangular hole 18 of the swinging door 4 in this example, on the exterior side thereof, as shown in FIG. 19. The exterior frame 28 is positioned to permit the circular bushings 30 thereof to be inserted into the predrilled holes 26 on the exterior side of door 4. The mounting into the swinging door 4 of the hinge-flap assembly 20, interior frame 22, and exterior frame 28 is completed by inserting the screws 32 into the holes 34 of interior frame 22, whereby the screws are then tightly screwed into the bushings 30 of the exterior frame 28, as shown in FIG. 20. When completed, assembly from the interior side of the swinging door 4 is shown in FIG. 21. Note that in this example, door 4 has a knob 5 and can be hung for opening inward or outward from the right relative to the interior.

Figure 22:
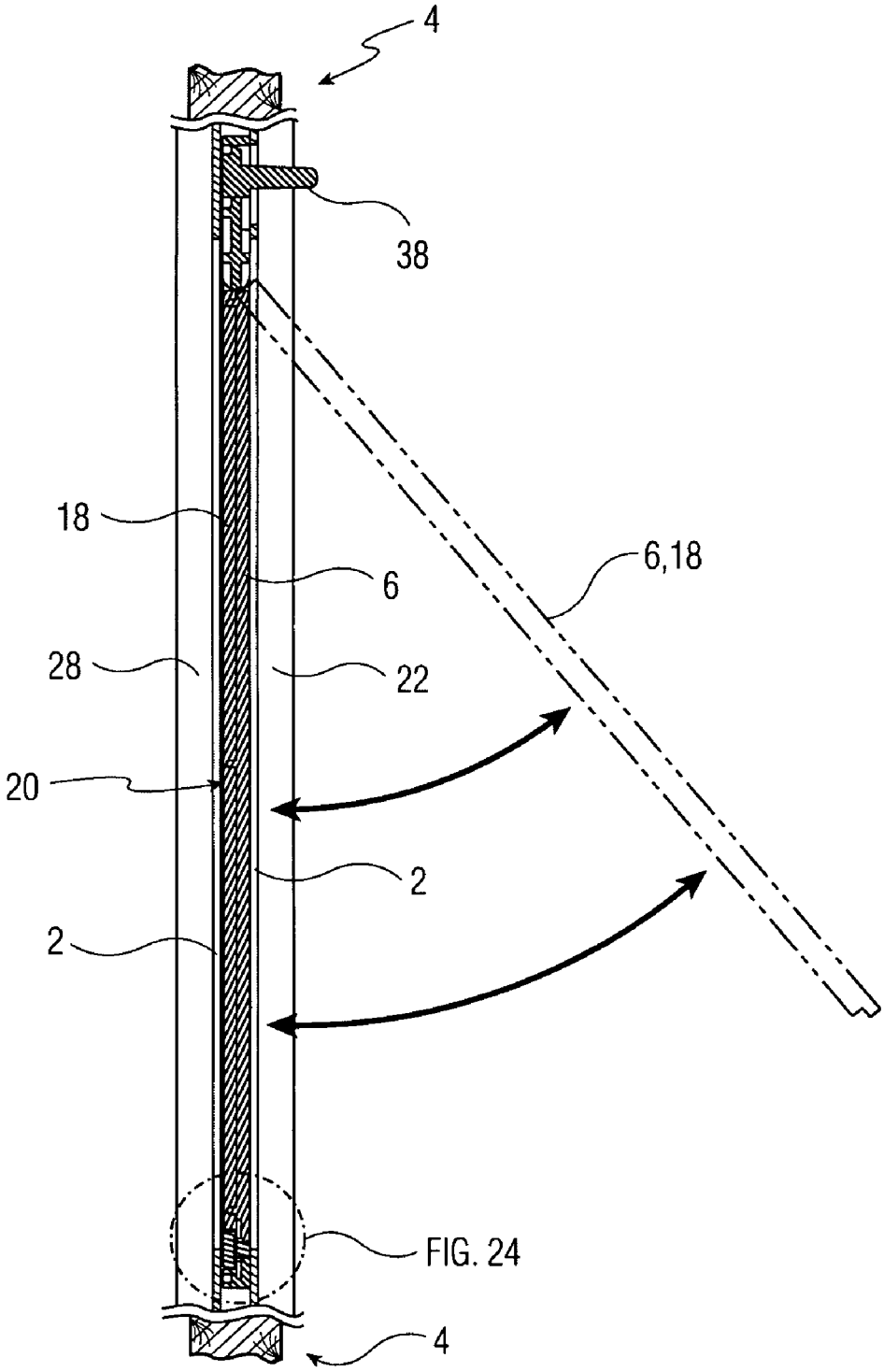
FIG. 22 shows a partially cutaway side and central longitudinal cross sectional view of positioning of the movable flap for allowing the flap to only open inward or interior wise from the interior frame.

The operation of the present hinge-flap assembly will now be described. In FIG. 22, a partial cross section and partial cutaway side view is shown of the present assembly as mounted within a swinging door 4, or within an appropriate sized hole in any wall structure, sliding patio door insert, and so forth, but not limited thereto. The bezel handle 38 is operable by pushing it inward to permit the bezel locking hinge 10 to be selectively moved to an upwardmost position, or mid-position, or a lowermost position, whereby the main hinge-flap assembly 20 can be moved or positioned vertically therewith.

Figure 23:
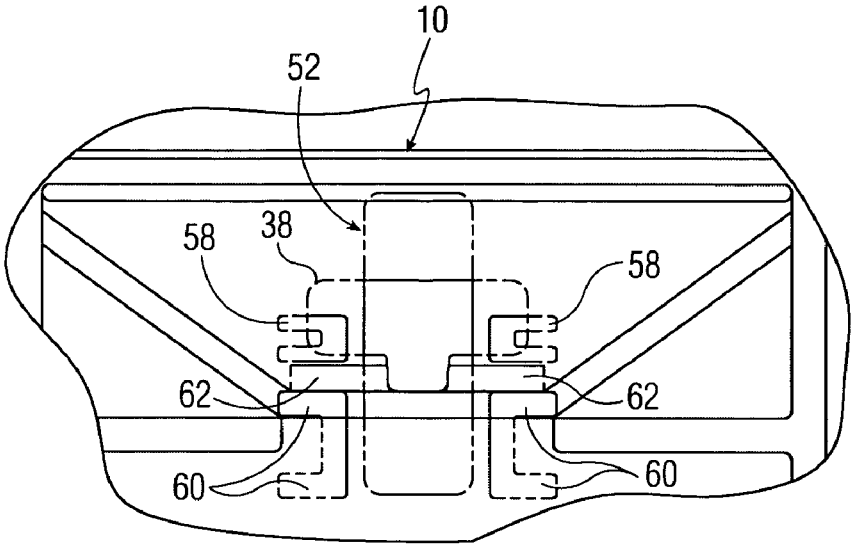
FIG. 23 is a detailed view looking inward at the back of the interior frame through the bezeled locking hinge for showing the positioning of the operating handle mechanism relative to interior locking tabs for maintaining the flap operation in a halfway position as shown in FIG. 22.
Figure 24:
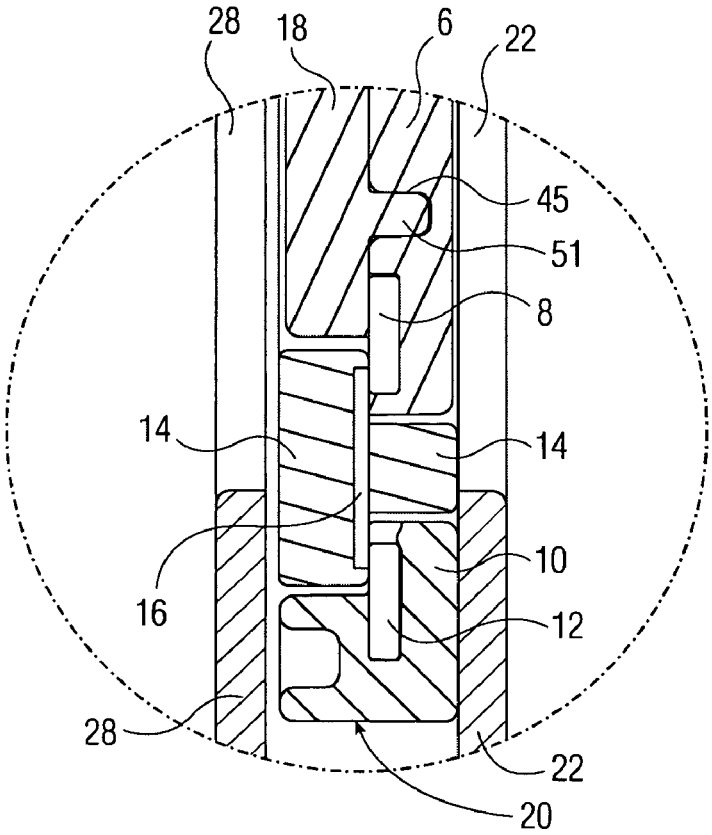
FIG. 24 is a detailed partial cross sectional view showing the location of the flap door and flap seal between the interior and the exterior frame for allowing the flap door to operate as shown in FIG. 22.

With reference to FIGS. 22 through 24, when the bezel hinge with the main hinge-flap assembly 20 is moved to a mid-position as shown, the interior flap door 6 and exterior flap door 18, as cojoined can be moved away from the interior frame 22 for permitting the ingress of a pet through the pet portal, in this example. In FIG. 23, looking through the bezel hinge 10 at the back of the interior frame 22, a first pair of spaced apart interior locking tabs 58 are positioned as shown on the back of the interior frame 22. A second pair of interior locking tabs 60 are spaced apart from one another, and each are spaced vertically below the first set of interior locking tabs 58 on the back of interior frame 22, as shown. The bezeled handle 38 is pushed in to release the bezel hinge 10 with the hinge-flap assembly 20 for vertical movement. The position shown in FIG. 23 is secured when the bezel handle 38 is released causing a locking tab 62 to be positioned as shown between the first and second pairs of locking tabs 58 and 60 on the back of the interior frame 22. With the bezel locking hinge 10 and hinge-flap assembly 20 in this position, as shown in FIG. 24, lower portions of the bezel locking hinge 10 and opposing flap ring portion 14 are trapped between the interior frame 22 and exterior frame 28. Also in this position, the hinge-flap assembly 20 is sealed via the interaction between the flap door magnet 8 and the interior flap door 6, and the ferromagnetic metal material 16 molded into the flap ring or seal 14. In addition the lower portion of the ferromagnetic metal bar 16 is magnetically attracted to the bezel locking hinge magnet 12 carried by the bezel locking hinge 10, as shown. When a pet pushes against the front of the exterior flap 18, the magnetic seal between the flap door magnet 8 and metal bar 16 of flap ring 14 is broken, whereby the pet is then able to move the cojoined exterior flap 18 and interior flap 6 inward, with flap ring 14 remaining in place, for permitting the pet to ingress or pass through the associated pet portal into the interior of the facility associated with the swinging door 4, in this example.

Note further that in the rest position of the flap assembly 20 as shown in FIG. 24, for example, the inward directed step from exterior flap 18 to interior flap 6 is magnetically clamped to the upper inwardly directed step of flap ring 14 via magnetic attraction between magnet 8 and ferromagnetic bar 16. Also, the lower inwardly directed step 27 of flap ring 14 is magnetically clamped to the inwardly directed step 29 of bezel locking ring 10 via magnetic attraction between ferromagnetic bar 16 and bezel magnet 12.

Figure 25:
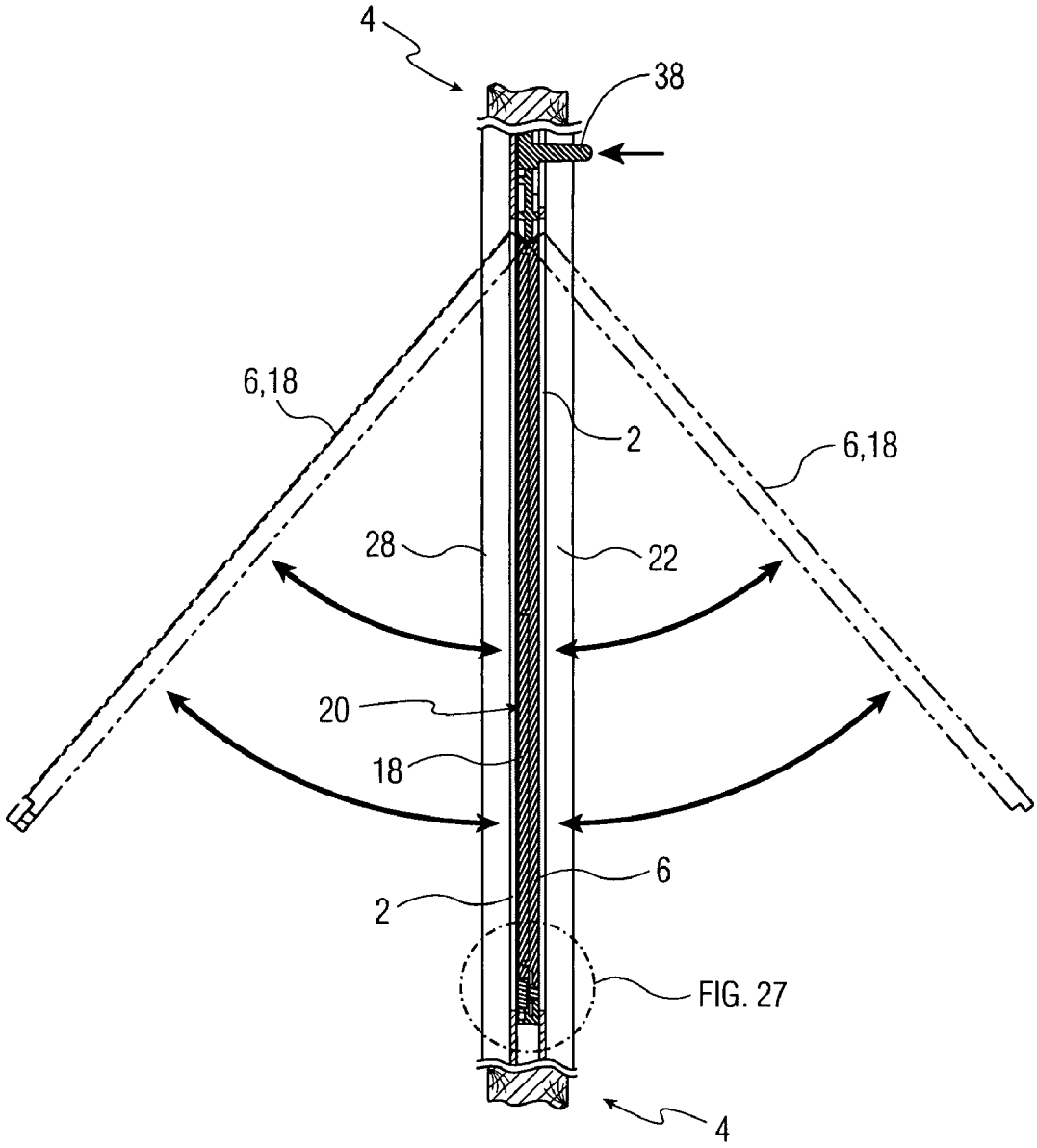
FIG. 25 shows a partially cutaway side and central longitudinal cross sectional view of the positioning of the moveable flap for permitting the flap to move in a direction away from the exterior frame or in a direction away from the interior frame, for allowing a pet full ingress or egress through the pet portal for an embodiment of the invention.
Figure 26:
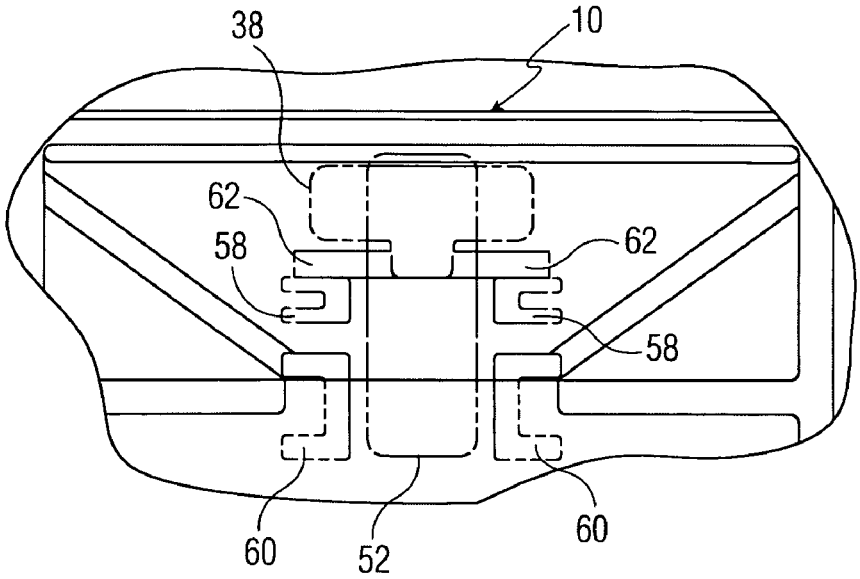
FIG. 26 is a detailed view showing the positioning of the operating handle relative to the locking tabs on the interior frame for flap operation as in FIG. 25.
Figure 27:
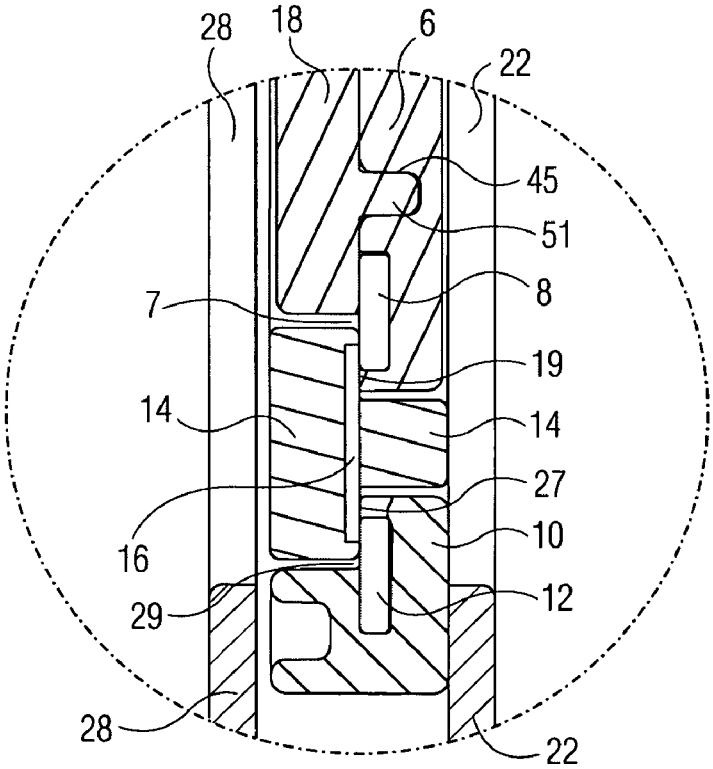
FIG. 27 shows the positioning of the bottom portion of the flap in a cross sectional detail for permitting operation of the flap or full movement of the flap as shown in FIG. 25.

The cojoined interior and exterior flaps 6, 18, respectively, can be permitted to move inward or outward relative to the swinging door 4, that is clockwise or counterclockwise from the vertical rest position as shown in FIG. 25, for allowing a pet complete ingress or egress through the associated pet portal. To obtain this operation, the bezel handle 38 is pushed inward to move the flap assembly 20 vertically, and released after the bezel locking tab 62 thereof is positioned on top of the interior locking tabs 58 as shown in FIG. 26. When in this position, as shown in FIG. 27, lower portions of the flap ring 14, and exterior flap 18 cojoined with interior flap 6, are vertically held free of and above the channel formed between the exterior frame 28 and interior frame 22, as shown in FIG. 27. In this position, a weather seal is maintained as previously described relative to FIG. 24 for the half-way or ingress position of the hinge flap assembly 20. In this position, the cojoined exterior flap 18 and interior flap 6 can be moved counterclockwise inward for permitting a pet ingress through the pet portal, as previously described. Also, a pet on the interior side of the hinge flap assembly 20 pushes against the interior flap door, for overcoming the magnetic attraction between the bezel locking hinge magnet 12 and the metal bar 16, for causing the cojoined interior and exterior flaps 6, 18, respectively, to swing clockwise outward with flap ring 14 for permitting the pet egress through the pet portal.

Figure 28:
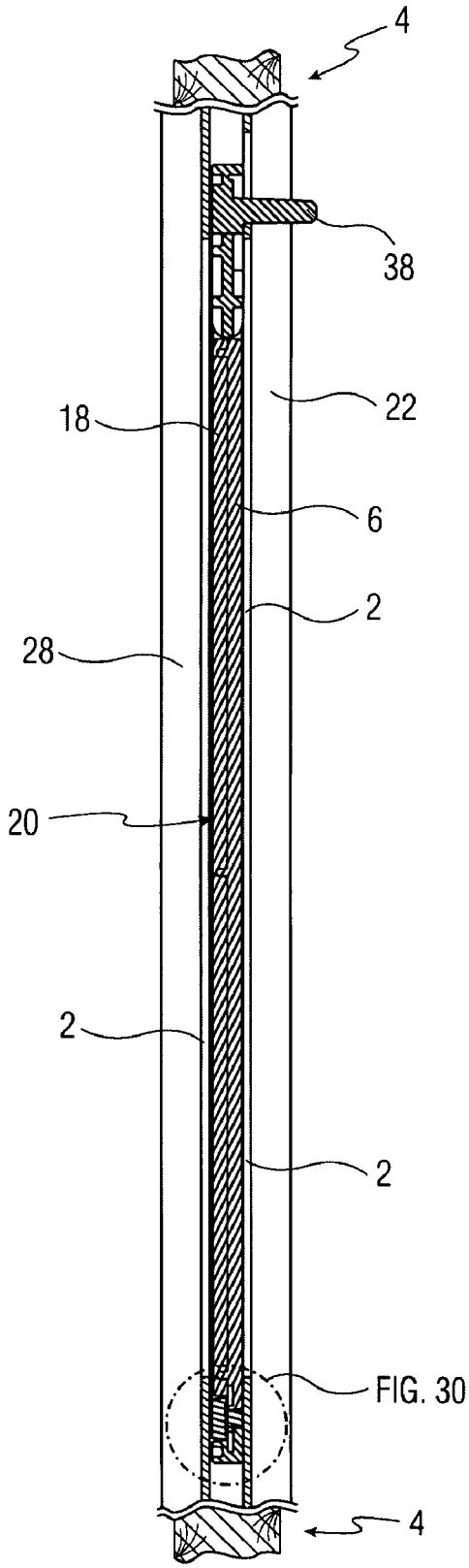
FIG. 28 shows a partial cutaway side and central longitudinal cross sectional view of the flap in a closed position, that is its lowermost position.
Figure 29:
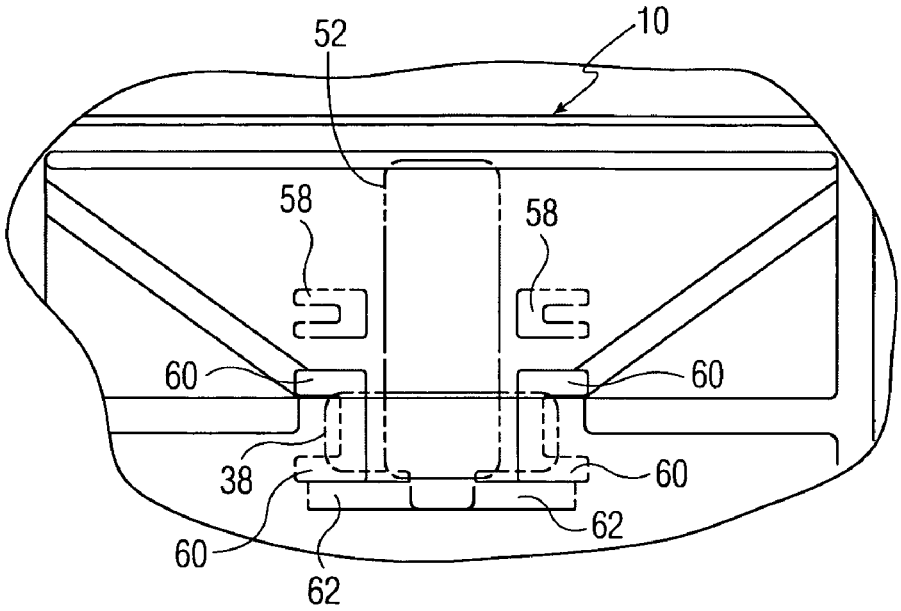
FIG. 29 is a detailed view showing the positioning of the bezel handle locking tab looking through the hinge bezel at the back of the interior frame relative to the locking tabs located on the back of the interior frame.
Figure 30:
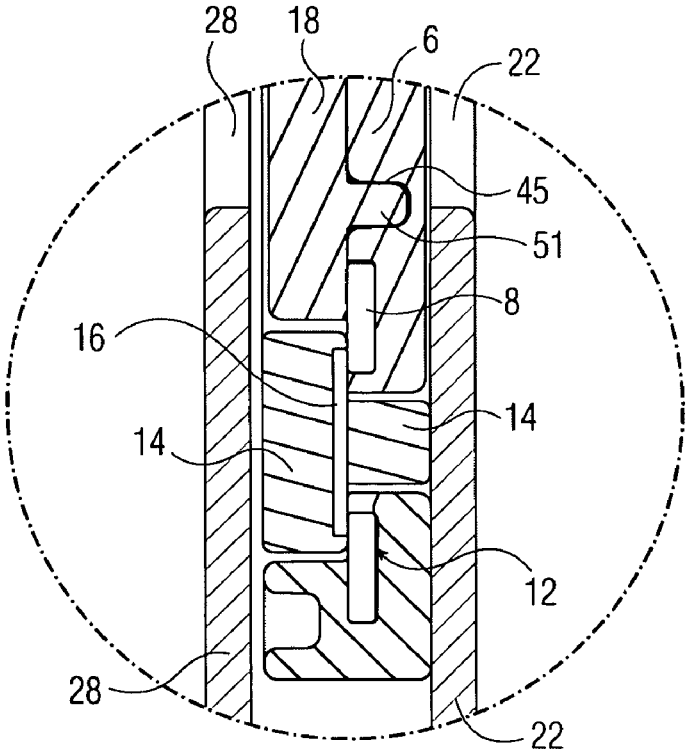
FIG. 30 shows a detailed partial cutaway view of the lower portion of the flap and bezel hinge as entrapped between the interior and exterior frames, in the closed position of FIG. 28, for preventing movement of the flap.

As shown in FIGS. 28 through 30, for operation of the bezel handle 38, as previously described, the bezel locking tab 62 can be positioned as shown in FIG. 29 below the second pair of interior locking tabs 60. In this position, the hinge-flap assembly 20 is vertically moved to its downwardmost position, wherein its lower portion is positioned in the channel formed between the interior frame 22 and exterior frame 28 as shown in the detailed cross-sectional view of FIG. 30. As shown in this position, the ferromagnetic bar 16 in the flap ring 14 is magnetically joined to the interior flap door magnet 8, and to the bezel locking hinge magnet 12, as shown, and the cojoined interior flap 6 and exterior flap 18 are prevented from moving inward or outward because of their lowermost portions being entrapped between the interior frame 22 and exterior frame 28, as shown.

Figure 31A:
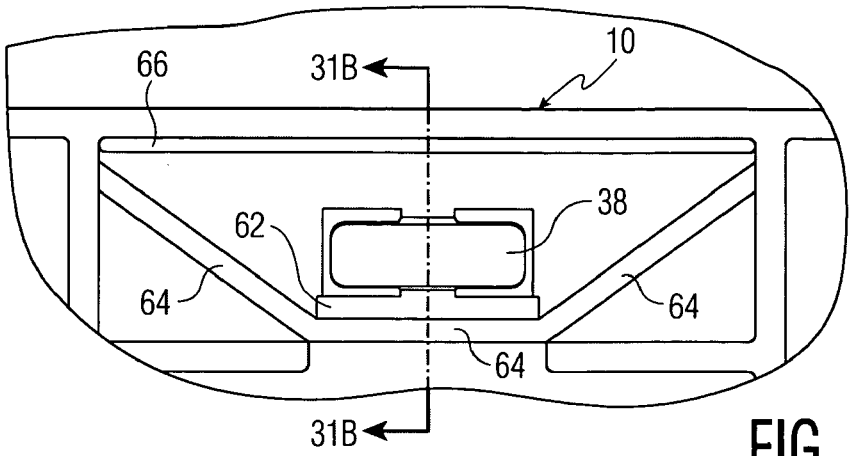
FIG. 31A is a detailed view of the handle and living hinge configuration for the upper back portion of the bezel locking hinge.
Figure 31B:
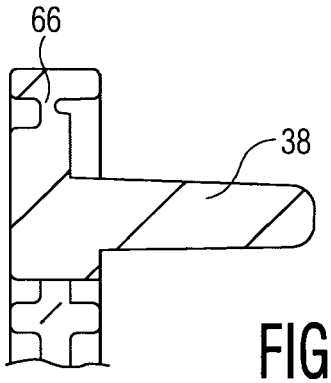
FIG. 31B shows a cross-sectional cutaway view of the design of the bezel handle mechanism including a living hinge and locking tab.
Figure 31C:
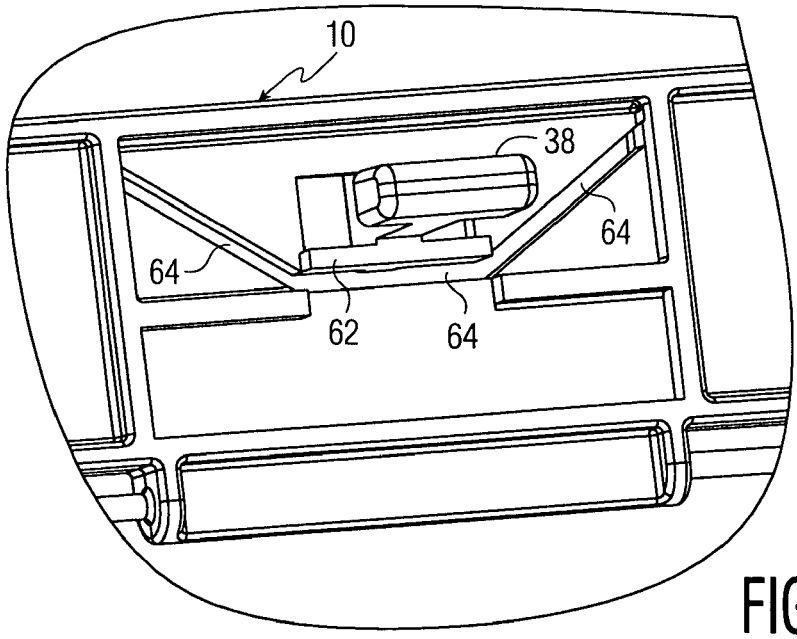
FIG. 31C is a detailed view of the upper front portion of the bezel hinge showing the bezel handle operating mechanism in further detail relative to FIGS. 31A and 31B.

In the preferred embodiment of the invention, the operation of the bezel handle 38 and its bezel locking tab 62, and the design thereof will now be described. As shown in FIG. 31A, the bezel locking hinge 10, bezel handle 38, and bezel locking tab 62 are all formed from a single piece of plastic material. Cut-through narrow areas 64 are provided, as shown. A thin area flex point 66 (a living hinge) is provided as shown in FIG. 31A, and in the cross-sectional detail view of FIG. 31B. Through use of the cutout portion 64, and the thin area flex point 66, the tab handle 38 can be pushed inward along with its integral bezel locking tab 62, for moving the bezel locking hinge 10 and its associated hinge-flap assembly 20 selectively to either the opened position for permitting a pet ingress and egress, the middle position for only permitting a pet ingress, or to the closed position for preventing any movement of the cojoined flaps 6, 18, respectively, as previously described. FIG. 31C is a enlarged pictorial view showing the configuration of the bezel handle 38 and its associated locking tab 62, relative to the openings 64.

Figure 32A:
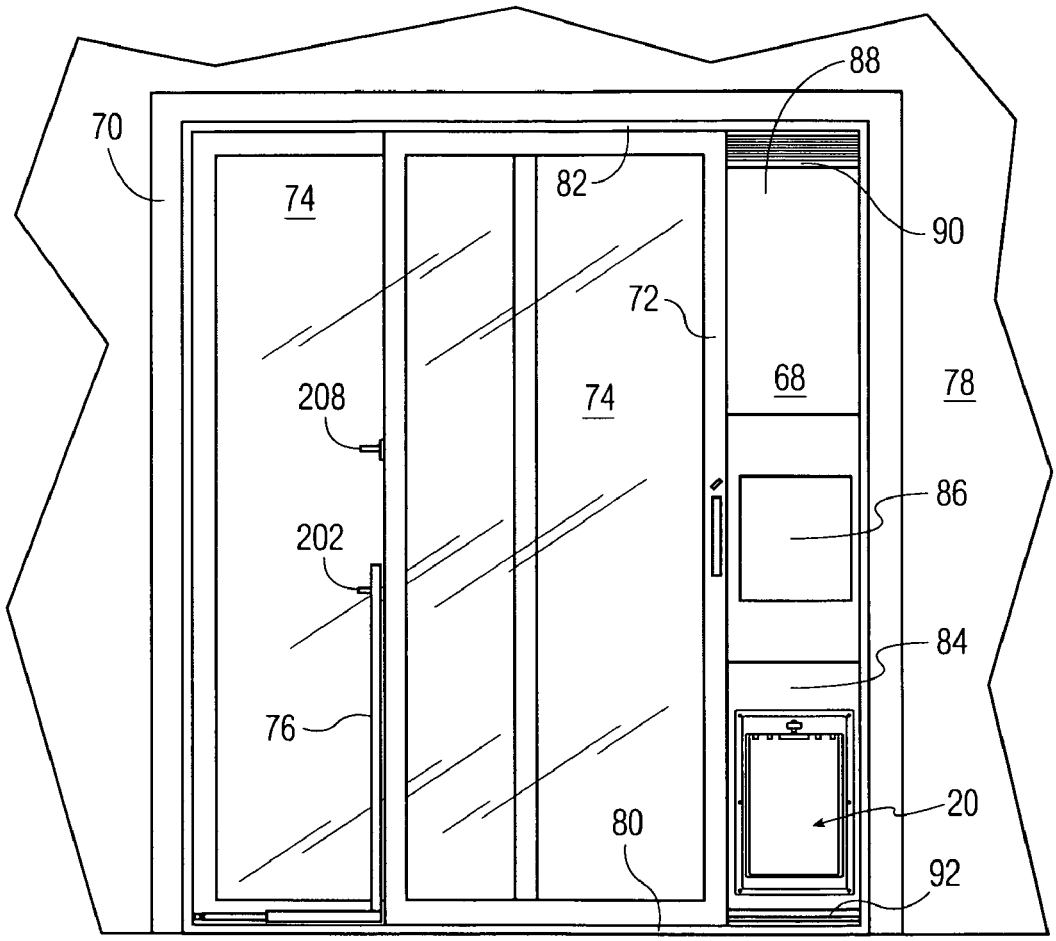
FIGS. 32A and 32B show interior and exterior elevational views of a sliding glass patio door with a pet door panel installed therewith along with the present pet portal, for example.
Figure 32B:
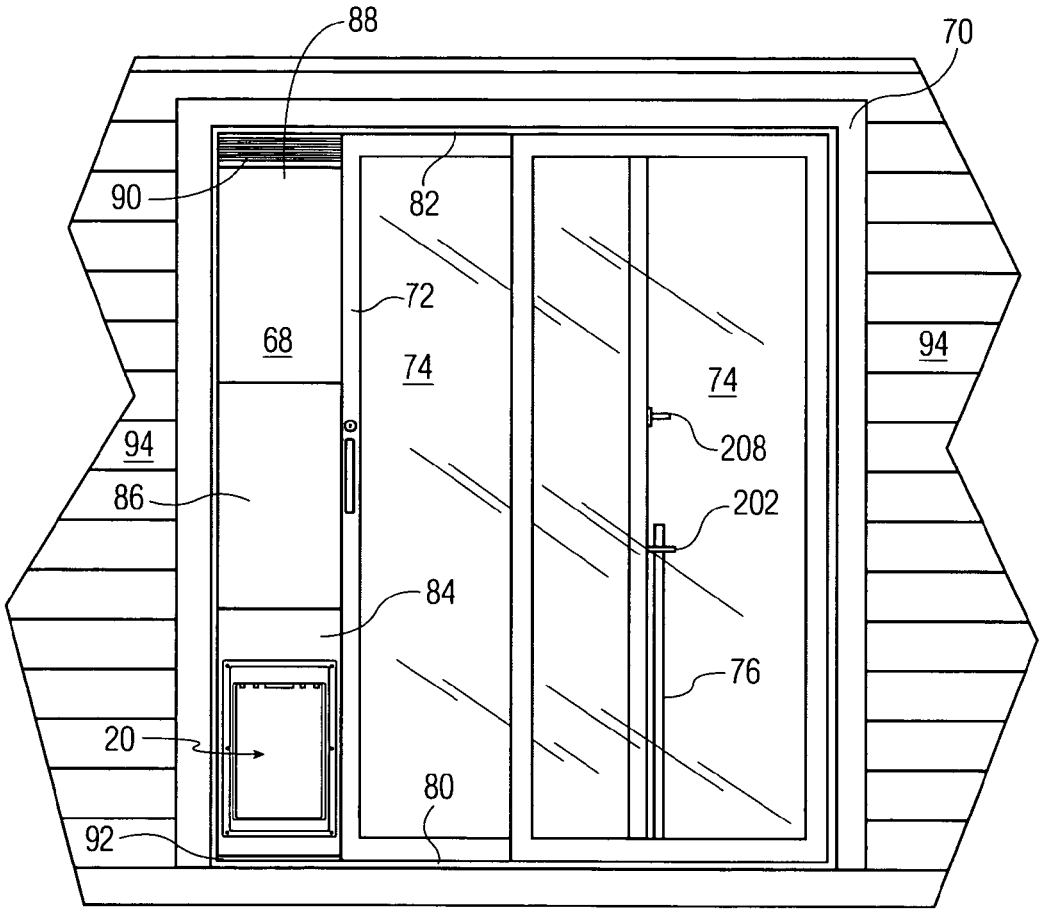

As previously mentioned, the present hinge flap assembly 20 is not limited for use in just swinging doors 4, as illustrated above. For example, as shown in FIGS. 32A and 32B, a pet door panel 68 is installed between a sliding door frame 70, and a leading side of a frame 72 on a moveable sliding door 74, for a home or building 94, to provide a means of ingress and egress for a pet. In this example, a drop lock security lock 76 is installed on the interior side of the stationary sliding door 74, between the sliding door frame 70, and the trailing side of frame 72, to secure the pet door panel 68 between the sliding door frame 70 and the leading side of frame 72, to prevent the moveable sliding door 74 from being opened with the pet door panel 68 installed. The sliding door frame 70 is typically secured to a building structure 28, such as a home or office. The sliding door frame 70 has a lower track portion 80 and upper track portion 82. The lower track portion 80 slideably receives at least one sliding door member 74 therein. The complementary upper track portion 82 is typically positioned on the upper side of the sliding glass door frame 70, in alignment with the lower track portion 80, enabling the sliding door member 74 to be slideably moved between open and closed positions within the sliding door frame 70. As described in detail in related U.S. Pat. No. 7,207,141, the drop lock security lock 76 in association with a locking bracket 202, is operable for preventing opening of the sliding door member 74. Storage bracket 208 is provided for storing the drop lock security lock 76 when not in use. In this example, the present pet door panel or hinge-flap assembly 20 is installed within the bottom module 84 of the pet door panel 68. Also included is a center module 86, and a top module 88, a top module weather seal 90, a bottom module weather seal 92, all for providing the pet door panel 68. The present hinge-flap assembly 20 provides an alternative design and operation to the pet portal 146 of the aforesaid patent. FIG. 32B is the exterior side of the pet door panel 68 looking toward the back of the building or home 94, with the present hinge-flap assembly 20 installed in the pet door panel 68.

The interior frame 22, exterior frame 28, interior flap 6, exterior flap 18, flap ring 14, and bezel locking hinge 10, including said bezel handle 38, bezel locking tab 62, and plurality of lateral hinge posts 44, each can consist of a single piece of plastic material. The plastic material is preferably polycarbonate.

Although various embodiments of the invention have been shown and described, they are not meant to be limiting. Those of skill in the art may recognize certain modifications to these embodiments, which modifications are meant to be covered by the spirit and scope of the appended claims. For example, the magnets 8 and 12 can be substituted by ferromagnetic metal bars, respectively, with ferromagnetic metal bar 16 being replaced by a magnetic bar having sufficient magnetic strength for the required magnetic clamping described above

What is claimed is:

1. A three-position pet portal for installation in either a cutout portion in a lower section of a door, wall, or a lowermost section of an insert for a sliding patio door, said pet portal comprising:

an interior frame for securement to circumferential side portions of said cutout portion on an interior side thereof;

an exterior frame for securement to circumferential portions of said cutout portion on an exterior side thereof;

a flap assembly mounted within said cutout portion between said interior and exterior frames, including:

a flap; and bezel locking tab on the flap and at least two interior locking tabs on a back portion of said interior frame, the bezel locking tab selectively engaging the interior locking tabs for selectively positioning said flap assembly in either one of three vertical positions relative to said cutout portion, namely, an uppermost position for permitting said flap to move pivotally inward or outward from openings in said interior and exterior frames to allow a pet ingress or egress relative to said portal, a middle position for only allowing said flap to move pivotally inward to allow a pet ingress through said portal, and a lowermost position to lock said flap vertically in place preventing a pet any ingress or egress through said portal.

2. The pet portal of claim 1, wherein said positioning means further includes:

means for insuring said flap always returns to a rest position between said interior and exterior frames after pivotal movement.

3. The pet portal of claim 2, wherein said positioning means further includes:

a bezeled locking hinge including a plurality of lateral hinge posts in an upper portion thereof, and an open frame in a lower portion formed by opposing sides joined at bottom ends by a bottom cross member;

said flap including an interior flap section, and an exterior flap section, respectively, each having a closed front, and a closed back;

said interior flap section including a plurality of uppermost lateral mounting hinges for mounting upon interior half-portions of said plurality of lateral hinge posts of said bezeled locking hinge, and further including first and second hinge pockets proximate extreme right and left top ends, respectively, in horizontal alignment with said mounting hinges;

a flap ring formed from a unitary U-shaped member having a bottommost cross member, and two spaced apart vertical arms each having free ends with inwardly protruding hinge posts for partial insertion into said first and second hinge pockets, respectively, of said interior flap section;

said exterior flap section including a plurality of uppermost lateral mounting hinges for mounting upon remaining interior half portions of said plurality of lateral hinge posts of said bezeled locking hinge, in opposition to said interior flap section, and first and second hinge pockets proximate extreme right and left top ends, respectively, in horizontal alignment with said mounting hinges, for receiving remaining portions of said hinge posts of said two vertical arms of said flap ring, respectively;

means for securing said interior and exterior flap sections together, said interior flap section being longer and wider than said exterior flap section, whereby a bottom and side portions of said interior flap section extend beyond bottom and side portions of said exterior flap section, forming an inwardly directed step from the side and bottom portions of said exterior flap to said interior flap;

said flap ring further including an inwardly directed first step across an inner portion of its cross member and inner portions of its opposing said vertical arms, for receiving opposing portions of the inwardly directed step between said interior and exterior flap sections, both when at rest, and when said flap assembly has the flap sections moved pivotally outward, whereby said flap ring pivotally moves outward with said flap sections during egress of a pet through said pet portal, whereas when said flap pivotally moves inward during ingress of a pet through said pet port, said flap ring remains vertically at rest;

said flap ring further including an inwardly directed second step across a lower portion of its cross member; and said bezeled locking hinge further including a recessed pocket across an upper portion of its cross member for receiving the lower inwardly directed second step of said flap ring at rest.

4. The pet portal of claim 1, wherein said positioning means further includes:

a bezeled locking hinge including a plurality of lateral hinge posts in an upper portion thereof, and an open frame in a lower portion formed by opposing sides joined at bottom ends by a bottom cross member;

said flap including an interior flap section, and an exterior flap section, respectively, each having a closed front, and a closed back;

said interior flap section including a plurality of uppermost lateral mounting hinges for mounting upon interior half-portions of said plurality of lateral hinge posts of said bezeled locking hinge, and further including first and second hinge pockets proximate extreme right and left top ends, respectively, in horizontal alignment with said mounting hinges;

a flap ring formed from a unitary U-shaped member having a bottommost cross member, and two spaced apart vertical arms each having free ends with inwardly protruding hinge posts for partial insertion into said first and second hinge pockets, respectively, of said interior flap section;

said exterior flap section including a plurality of uppermost lateral mounting hinges for mounting upon remaining interior half portions of said plurality of lateral hinge posts of said bezeled locking hinge, in opposition to said interior flap section, and first and second hinge pockets proximate extreme right and left top ends, respectively, in horizontal alignment with said mounting hinges, for receiving remaining portions of said hinge posts of said two vertical arms of said flap ring, respectively;

means for securing said interior and exterior flap sections together, said interior flap section being longer and wider than said exterior flap section, whereby a bottom and side portions of said interior flap section extend beyond bottom and side portions of said exterior flap section, forming an inwardly directed step from the side and bottom portions of said exterior flap to said interior flap;

said flap ring further including an inwardly directed first step across an inner portion of its cross member and inner portions of its opposing said vertical arms, for receiving opposing portions of the inwardly directed step between said interior and exterior flap sections, both when at rest, and when said flap assembly has the flap sections moved pivotally outward, whereby said flap ring pivotally moves outward with said flap during egress of a pet through said pet portal, whereas when said flap pivotally moves inward during ingress of a pet through said pet port, said flap ring remains vertically at rest;

said flap ring further including an inwardly directed second step across a lower portion of its cross member; and said bezeled locking hinge further including a recessed pocket across an upper portion of its cross member for receiving the lower inwardly directed second step of said flap ring at rest.

5. The pet portal of claim 3, wherein said rest position return means includes:

a first ferromagnetic material secured within a pocket located in a center portion proximate the bottom of a back face of said interior flap section opposing said first step of said flap ring;

a second ferromagnetic material secured within a center portion of said first and second steps of said flap ring, for interacting attractively with said first ferromagnetic material; and a third ferromagnetic material secured within said recessed pocket of said locking hinge in opposition to a portion of said second ferromagnetic material in the second step of said flap ring, for interacting attractively therewith.

6. The pet portal of claim 5, wherein said first and third ferromagnetic materials are each permanent magnets.

7. The pet portal of claim 1, wherein said interior frame, and said exterior frame, each consist of a single piece of plastic material.

8. The pet portal of claim 7, wherein the plastic material is polycarbonate.

9. The pet portal of claim 3, wherein said interior frame, exterior frame, bezeled locking hinge, interior flap, exterior flap, and flap ring each consist of a single piece of plastic material.

10. The pet portal of claim 9, wherein said plastic material is polycarbonate.

11. The pet portal of claim 3, wherein said positioning means further includes:

a bezel handle protruding away from an uppermost central portion of an interior face of said bezeled locking hinge through a vertically elongated hole in said interior frame, said bezel handle being resiliently biased;

said bezel locking tab cojoined to and formed below said bezel handle;

a first pair of spaced apart locking tabs comprising one of said two interior locking tabs centrally and transversely located on a back portion of said interior frame opposing the interior face of said locking hinge;

a second pair of spaced apart locking tabs comprising the other of said two interior locking tabs centrally and transversely located vertically below and spaced from said first pair of spaced apart locking tabs;

said positioning means being operable by pushing in said bezel handle to move said bezel hinge and associated flap assembly at rest vertically upward or downward to either one of said three vertical positions, whereby when said bezel handle is released in the uppermost position, said bezel locking tab will be retained on upper portions of said first pair of locking tabs, or when said bezel handle is released in said middle position, said bezel locking tab will be retained on upper portion of said second pair of locking tabs, or when said bezel handle is released in said lowermost position, said bezel locking tab is retained on bottom portions of said second pair of locking tabs.

12. The pet portal of claim 11, further including:

a channel being formed between opposing lowermost portions of said interior and exterior frames;

whereby when said positioning means is in the uppermost postion, the interior flap section and the exterior flap section, said flap ring, and the inwardly directed step of said bezeled locking hinge are above and free of said channel;

whereby when said positioning means is in the middle position, the inwardly directed second step portion of said flap ring, and inwardly directed step of said bezeled locking hinge are within said channel;

whereby when said positioning means is in the lowermost position, the bottom portions of said exterior flap section and said interior flap section, the cross member of said flap ring, and the bottom cross member of said bezeled locking hinge are all within said channel.

13. The pet portal of claim 3, further including:

a plurality of strengthening ribs formed on the back of said interior flap section; and a plurality of strengthening ribs formed on the back of said exterior flap section.

14. The pet portal of claim 3, wherein said means for securing said interior flap section and said exterior flap section together, includes:

a plurality of spaced apart circular alignment studs on the back of said interior flap section; and a plurality of spaced apart blind alignment holes on the back of said exterior flap section, for receiving said plurality of alignment studs of said interior flap section, respectively, to insure when said interior flap section and said exterior flap section are bonded together via their back portions, a uniform inwardly directed step from bottom and side portions of said exterior flap section to said interior flap section is maintained.

15. The pet portal of claim 11, further including:

said bezel locking hinge, including said bezel handle, bezel locking tab, and plurality of lateral hinge posts, all being formed from a single piece of plastic material; and a living hinge being formed above said bezel handle, for permitting said bezel handle and its associated bezel locking tab to be moved inward in response to an inward force applied to said bezel handle, whereby said living hinge returns said bezel handle and bezel locking tab to a rest position upon the release of said inward force.

16. The pet portal of claim 15, wherein said plastic material is polycarbonate.

* * * * *